US007467658B2

(12) United States Patent
Kent et al.

(10) Patent No.: US 7,467,658 B2
(45) Date of Patent: Dec. 23, 2008

(54) DOWN HOLE DRILLING FLUID HEATING APPARATUS AND METHOD

(75) Inventors: Gerald Edward Kent, Spruce Grove (CA); David Leonwill Jones, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 237 days.

(21) Appl. No.: 11/006,641

(22) Filed: Dec. 8, 2004

(65) Prior Publication Data

US 2005/0173119 A1 Aug. 11, 2005

(30) Foreign Application Priority Data

Feb. 10, 2004 (CA) ..... 2457329

(51) Int. Cl.
*E21B 36/00* (2006.01)
*E21B 34/00* (2006.01)

(52) U.S. Cl. ..... 166/57; 166/302; 166/319; 166/373

(58) Field of Classification Search ..... 166/57, 166/302, 319, 373
See application file for complete search history.

(56) References Cited

U.S. PATENT DOCUMENTS

| | | | | |
|---|---|---|---|---|
| 2,968,345 | A | 1/1961 | Gamble | |
| 3,155,111 | A | 11/1964 | Presnell | |
| 4,051,864 | A | 10/1977 | Iwatsuki | |
| 4,176,630 | A | 12/1979 | Elmer | |
| 4,260,020 | A | 4/1981 | Nelson et al. | |
| 4,653,524 | A | 3/1987 | Wilson | |
| 4,669,541 | A | 6/1987 | Bissonnette | |
| 4,936,397 | A | 6/1990 | McDonald et al. | |
| 5,215,444 | A | 6/1993 | Bishoff | |
| 5,443,129 | A | 8/1995 | Bailey et al. | |
| 5,615,115 | A | 3/1997 | Shilling | |
| 5,826,661 | A | 10/1998 | Parker et al. | |
| 5,896,928 | A * | 4/1999 | Coon | 166/373 |
| 6,095,249 | A | 8/2000 | McGarian et al. | |
| 6,119,783 | A | 9/2000 | Parker et al. | |
| 6,158,533 | A | 12/2000 | Gillis et al. | |
| 6,250,806 | B1 | 6/2001 | Beshoory | |
| 6,276,458 | B1 | 8/2001 | Malone et al. | |
| 6,328,119 | B1 | 12/2001 | Gillis et al. | |
| 6,353,706 | B1 | 3/2002 | Bridges | |
| 6,494,265 | B2 | 12/2002 | Wilson et al. | |

(Continued)

OTHER PUBLICATIONS

Sperry-Sun Drilling Services "Adjustable Gauge Stabilizer (AGS-TM) Operations Manual," 17 pp.

*Primary Examiner*—Giovanna C Wright
(74) *Attorney, Agent, or Firm*—Terrence N. Kuharchuk; William Shull; William Peoples

(57) ABSTRACT

An apparatus for providing heat energy to a fluid, including a housing adapted for connection into a working string and for inserting into a borehole, a flow path for the fluid extending within the housing, a pressure drop device positioned within the flow path, and an actuator for actuating the apparatus between a minimum pressure drop position and a maximum pressure drop position. A method for providing heat energy to a fluid, including the steps of providing an apparatus in a borehole, actuating the apparatus to a maximum pressure drop position, and circulating the fluid through a pressure drop device which is positioned within a flow path in the apparatus.

50 Claims, 16 Drawing Sheets

U.S. PATENT DOCUMENTS

| | | | |
|---|---|---|---|
| 6,564,874 | B2 | 5/2003 | Narvaez |
| 6,622,794 | B2 | 9/2003 | Zisk, Jr. |
| 6,659,186 | B2 | 12/2003 | Patel |
| 6,719,071 | B1 | 4/2004 | Moyes |
| 6,837,313 | B2 | 1/2005 | Hosie et al. |
| 6,938,707 | B2 | 9/2005 | Schmidt et al. |
| 6,973,977 | B2 | 12/2005 | Naquin |
| 7,114,661 | B2 | 10/2006 | Goedde |
| 7,306,042 | B2 | 12/2007 | Bansal et al. |
| 2003/0066650 | A1 | 4/2003 | Fontana et al. |
| 2003/0079912 | A1 | 5/2003 | Leuchtenberg |
| 2003/0121663 | A1 | 7/2003 | Weng et al. |
| 2003/0127230 | A1 | 7/2003 | von Eberstein, Jr. et al. |
| 2003/0146001 | A1 | 8/2003 | Hosie et al. |
| 2004/0007361 | A1 | 1/2004 | McGarian et al. |
| 2004/0035578 | A1 | 2/2004 | Ross et al. |
| 2004/0182443 | A1 | 9/2004 | McIntosh |
| 2005/0173125 | A1* | 8/2005 | Naquin et al. ..... 166/373 |

* cited by examiner

DOWN HOLE DRILLING FLUID HEATING APPARATUS AND METHOD

FIELD OF INVENTION

An apparatus and a method for providing heat energy to a fluid. More particularly, an apparatus and a method for use in a borehole such as a wellbore for providing heat energy to a circulating fluid passing through a working string such as a drill string.

BACKGROUND OF INVENTION

During drilling operations, a circulating fluid such as a drilling fluid is typically circulated from the surface through a drill string down hole to the drill bit and returned to the surface through an annulus defined between the drill string and the borehole, which may be cased or open hole. The drilling fluid is circulated in order to cool and lubricate the drill bit and to permit the removal of rock cuttings and other debris from the borehole as it is being drilled. In addition, the drilling fluid may be utilized as a means for controlling the formation pressures and stresses during drilling, such as by providing a desired pressure in the borehole, and to thereby inhibit undesirable events such as blowout, fracture of the formation or borehole collapse.

More particularly, it may be desirable during drilling operations to maintain a pressure in the borehole which is greater than the adjacent formation pressure to prevent a blowout and influx of fluids from the formation onto the borehole. However, if the borehole pressure exceeds the fracture pressure of the formation, a formation fracture may occur. Thus, the formation fracture pressure typically defines the upper limit for allowable borehole pressure in an open or uncased borehole.

Often, the exposed formation in an open borehole immediately below or down hole of the lowermost portion of a casing string, such as an intermediate casing string, will tend to have the lowest fracture pressure in the open borehole. However, the lowest fracture pressure may occur at greater depths in the open borehole.

Changes in the borehole temperature caused by drilling operations and/or the passage of circulating fluids through the borehole may alter or affect the effective fracture gradient of a formation. The fracture gradient is the pressure per unit depth required to fracture or cause the rock of the formation to separate. For instance, circulation of drilling fluid may result in a temperature of the drilling fluid down hole which is lower than the static geothermal temperature, with the result that the drilling fluid may have a cooling effect on the surrounding formation. This cooling effect may reduce the near borehole formation stresses by thermal contraction and subsequent cracking of the rock wall and may result in a lower effective fracture gradient. Lower effective fracture gradients in turn may increase the likelihood of the occurrence of undesirable events such as formation fracture, lost circulation and borehole collapse.

For example, significant cooling of drilling fluid may occur prior to reaching sensitive or vulnerable sections of the borehole in deep water rigs where a large volume of drilling fluid resides in a riser section located between the rig on the ocean surface and the wellhead on the ocean floor. This riser section may be thousands of feet in length. For example, some deep water rigs in the Gulf of Mexico are now exceeding 10,000 feet of ocean depth. Thus, the drilling fluid in the riser section tends to be significantly cooled by the ocean. The cooling effect is especially pronounced during long time intervals between circulation events, such as when tripping drill pipe out and back in the borehole. During this time, the ocean water can cool the drilling fluid in the riser section through thermal conduction to near freezing temperatures. Further, if tripping drill pipe into the borehole, the drilling fluid in the drill pipe is also cooled, even if drilling fluid is added into the drill pipe from the surface during the operation.

Given that the drilling fluid in the riser section is not heated prior to circulation, when circulation does finally commence, this relatively cold drilling fluid proceeds down hole and eventually contacts the open hole borehole without having an opportunity to be warmed adequately by thermal conduction from the formation heat before exiting the bottom of the drill string. Attempts have been made to heat the drilling fluid on the surface prior to being conducted down hole. However the thermal conduction heat losses tend to be quite high and heat continues to be lost as the drilling fluid propagates through the riser section and below the ocean floor.

Accordingly, it would be desirable to minimize the cooling effect of a circulating fluid on an open borehole. Minimizing the cooling effect may increase the effective fracture gradient, thereby reducing the likelihood of undesirable events such as formation fracture, lost circulation and borehole collapse and thereby potentially reducing the number of casing strings required in order to drill and complete the borehole.

It would also be desirable to provide an apparatus for heating a circulating fluid in order to minimize the cooling effect of the circulating fluid in the borehole. It would be especially desirable to provide such an apparatus which heats the circulating fluid in the borehole so that heat energy provided to the circulating fluid is not dissipated before the circulating fluid reaches vulnerable sections of the borehole.

SUMMARY OF INVENTION

The present invention relates to an apparatus and method for providing heat energy to a fluid.

The invention is particularly suited for use in heating a fluid which is circulated through a working string which is positioned in a borehole such as a wellbore. In this application, the fluid may be comprised of liquid, gas, foam, a multiphase fluid or suspension, or mixtures thereof. Representative fluids include, but are not limited to drilling fluids, water and completion fluids. The apparatus of the invention may be included as a component in a drill string or other working string and the method of the invention may be utilized in conjunction with drilling, completion, workover or other wellbore operations.

The heating of such fluids may be desirable because it has been theorized that heating fluids which are in a borehole may assist in increasing the fracture gradient of the formations surrounding the borehole, thus making the borehole less prone to unintentional fracturing due to the hydrostatic and circulating pressures exerted by the fluid in the borehole.

The present invention is capable of providing heat energy to the fluid while the fluid is in the borehole, thus avoiding heat energy loss or dissipation which could occur if the fluid were heated at the surface and then introduced into the borehole.

The invention is based upon the concept of converting a source of energy into heat energy which is provided to the fluid. The source of the energy may be the fluid itself or may be provided externally of the fluid. Preferably the source of the energy is either directly or indirectly the fluid itself. As a result, preferably the source of the energy can be controlled by controlling the conditions under which the fluid is circulated in the borehole.

The providing of heat energy to the fluid using the invention may be constant or variable. Preferably the invention is configured so that the providing of heat energy to the fluid may be adjusted. Preferably the adjustment can be made from the surface, such as the surface of the borehole or the ocean or ground surface.

In an apparatus aspect, the invention is an apparatus for providing heat energy to a fluid, the apparatus comprising:

(a) a housing adapted for connecting into a working string and for inserting into a borehole;

(b) a flow path for the fluid extending within the housing;

(c) a pressure drop device positioned within the flow path; and (d) an actuator for actuating the apparatus between a minimum pressure drop position and a maximum pressure drop position.

In a method aspect, the invention is a method for providing heat energy to a fluid, the method comprising:

(a) providing an apparatus in a borehole, the apparatus comprising a flow path for the fluid and the apparatus further comprising a pressure drop device positioned within the flow path;

(b) actuating the apparatus to a maximum pressure drop position; and (c) circulating the fluid through the flow path and the pressure drop device.

The pressure drop device may be any device, structure or apparatus which is capable of generating an energy conversion or an energy loss in the form of heat energy, which heat energy may be provided to the fluid as it passes through the apparatus.

The pressure drop device may, for example, be comprised of a flow restriction in the cross-sectional area of the flow path and/or a tortuous path through the flow path, both of which generate energy losses in the fluid as it passes through the flow path. A flow restriction may, for example, be comprised of a constriction in the flow path, a flow restrictor device, an orifice assembly, a packing assembly or a surface configuration or texture of the flow path. A tortuous path may, for example, be comprised of an orifice assembly, a packing assembly or a labyrinthine pathway.

The pressure drop device may also, for example, be comprised of a mixing device, which converts and provides mixing energy to the fluid in the form of heat energy. A mixing device may, for example, be comprised of a pump, a motor or a mixing apparatus.

The pressure drop device may be actuatable so that the apparatus is actuatable between the minimum pressure drop position and the maximum pressure drop position by actuating the pressure drop device. Alternatively the pressure drop device may be fixed and thus non-actuatable so that the apparatus is actuated between the minimum pressure drop position and the maximum pressure drop position in some other manner, such as by altering the flow of the fluid through the flow path.

In some embodiments, the pressure drop device may be comprised of a valve mechanism which is actuatable by the actuator in order to actuate the apparatus. The valve mechanism may be comprised of any type of mechanism which causes an energy loss to be experienced by the fluid as it passes through the flow path and which is actuatable by the actuator to provide a variable energy loss of the fluid. The valve mechanism may, for example, be comprised of a variable and actuatable flow restriction and/or a variable and actuatable tortuous path. In one preferred embodiment, a valve mechanism is comprised of an orifice and a flow restrictor member.

In other embodiments, the pressure drop device may be comprised of an actuatable device which causes a provision of energy to the fluid as it passes through the flow path, such as a mixing device. The mixing device may be comprised of any device which is capable of providing energy to the fluid through the application of forces to the fluid as it passes through the mixing device. In one preferred embodiment a mixing device is comprised of a pump.

In yet other embodiments, the pressure drop device may be comprised of a non-actuatable device which either causes an energy loss in the fluid or which causes a provision of energy to the fluid, in which case the apparatus may be actuated between the minimum pressure drop position and the maximum pressure drop position by controlling the flow of the fluid through the flow path and the pressure drop device. For example, the pressure drop device may be comprised of a flow restriction and/or a tortuous path and/or a mixing device and the apparatus may be further comprised of a flow control device for controlling the flow of the fluid through the flow path and the pressure drop device.

Where the pressure drop device is comprised of a device which causes a provision of energy to the fluid, the source of the energy may be unrelated to the fluid. For example, a mixing device may utilize a source of power which is independent of the fluid. Preferably, however, the source of power for the pressure drop device is the fluid itself, so that the source of the heat energy is indirectly the fluid itself. In one preferred embodiment where the pressure drop device is comprised of a mixing device, the source of power for the mixing device is preferably comprised of a motor which is in turn powered by the fluid.

The pressure drop device may be comprised of a single device or may be comprised of a plurality of devices, which plurality of devices may be configured in any suitable manner. The plurality of devices may be similar or different.

The pressure drop device may be configured so that heat energy is always provided to the fluid as it passes through the flow path. Preferably, however, the invention includes the actuator for actuating the apparatus between a minimum pressure drop position and a maximum pressure drop position. The minimum pressure drop position and the maximum pressure drop position are relative positions, and some amount of heat energy may be provided to the fluid when the apparatus is at the minimum pressure drop position.

The actuator may be comprised of a "one-time" actuator or the actuator may be capable of repeatedly actuating the apparatus between the minimum pressure drop position and the maximum pressure drop position. For example, the actuator may be comprised of a plug or ball which may be passed through the working string and the apparatus in order to actuate the pressure drop device or to actuate a flow path bypass. Preferably, however, the actuator is capable of repeatedly actuating the apparatus back and forth between the minimum pressure drop position and the maximum pressure drop position.

Preferably the actuator is adapted to actuate the apparatus between the minimum pressure drop position, the maximum pressure drop position, and at least one intermediate pressure drop position, thus providing additional flexibility in managing the provision of heat energy to the fluid.

The actuator may actuate the apparatus between the minimum pressure drop position and the maximum pressure drop position by actuating any component or components of the apparatus. For example, in some embodiments the pressure drop device is actuatable so that the actuator actuates the pressure drop device, while in other embodiments the actuator actuates a flow control device which controls a flow path flow rate through the flow path and the pressure drop device.

The actuator may actuate the apparatus in any suitable manner. For example, the actuator may actuate the apparatus mechanically, hydraulically, electrically, electro-mechanically, electro-hydraulically or hydro-mechanically. In addition, the actuator may actuate the apparatus by causing any suitable movement to actuate the apparatus including, for example, longitudinal movement, rotational movement, radial movement or combinations thereof.

In some embodiments, the actuator actuates the apparatus hydraulically or hydro-mechanically through longitudinal movement. More particularly, in such embodiments the actuator may provide a longitudinal movement to actuate the apparatus. The longitudinal movement may be controlled by a pressure exerted by the fluid directly or indirectly on the actuator.

In other embodiments, the actuator actuates the apparatus hydraulically or hydro-mechanically through rotational movement. More particularly, in such embodiments the actuator may provide a rotational movement to actuate the apparatus. The rotational movement may be controlled by a pressure exerted by the fluid directly or indirectly on the actuator.

In some preferred embodiments, the apparatus of the invention includes a linear actuator which is capable of indexing and thus controlling the longitudinal movement of the actuator in response to the pressure exerted by the fluid on the actuator. In these preferred embodiments, the linear actuator may be comprised of a barrel cam and pin assembly, in which the pin moves along a track or groove in the barrel cam in response to the pressure exerted by the fluid on the actuator. The longitudinal movement of the actuator is limited by the relative longitudinal range of motion of the barrel cam and the pin.

In other preferred embodiments, the apparatus of the invention includes a rotary actuator which is capable of indexing and thus controlling the rotational movement of the actuator in response to the pressure exerted by the fluid on the actuator. In these preferred embodiments, the rotary actuator may also be comprised of a barrel cam and pin assembly, in which the rotational movement of the actuator is limited or indexed by the relative range of longitudinal motion of the barrel cam and the pin.

In a first preferred embodiment, the pressure drop device is comprised of a plurality of valve mechanisms which are actuatable by the actuator. The valve mechanisms are configured in series. Each of the valve mechanisms is comprised of an orifice and is further comprised of a flow restrictor member for positioning relative to the orifice to adjust the flow path by causing a flow restriction in the flow path.

In the first preferred embodiment, the actuator is comprised of a mandrel which is connected to one of the flow restrictor members and which is movable longitudinally in response to pressure exerted on the mandrel by the fluid. In the first preferred embodiment, the longitudinal movement of the mandrel causes relative longitudinal movement of each of the orifices and the flow restrictor members. The longitudinal movement of the mandrel is controlled by a barrel cam and pin assembly. As a result, in the first preferred embodiment, the operation of the actuator and the resulting actuation of the valve mechanism may be controlled by varying the pressure exerted by the fluid on the mandrel.

In a second preferred embodiment, the pressure drop device is comprised of a tortuous path which is comprised of an orifice assembly. The orifice assembly defines a tortuous path for the fluid through the flow path. The orifice assembly is comprised of a plurality of orifice flanges which are spaced longitudinally in the flow path. The orifice flanges are preferably comprised of longitudinally alternating inner orifice flanges and outer orifice flanges. The orifice assembly may be constructed as a single piece component or may be constructed of a plurality of components such as a plurality of orifice members.

In the second preferred embodiment the orifice assembly is constructed of a plurality of longitudinally spaced orifice members, with each of the orifice members comprising a separate orifice flange so that the orifice assembly is comprised of a plurality of longitudinally alternating inner orifice flange members and outer orifice flange members.

In the second preferred embodiment, the apparatus is further comprised of a flow control device for controlling a flow path flow rate of the fluid through the flow path. The flow control device is actuatable by the actuator to alter the flow path flow rate in order to actuate the apparatus between the minimum pressure drop position, the maximum pressure drop position, and preferably at least one intermediate pressure drop position.

The flow control device is preferably comprised of a flow control valve mechanism, and the flow control valve mechanism is preferably actuatable between a first position corresponding to the minimum pressure drop position, a second position corresponding to the maximum pressure drop position, and an intermediate position corresponding to the intermediate pressure drop position. The first position of the flow control valve mechanism provides a minimum flow path flow rate, the second position provides a maximum flow path flow rate and the intermediate position provides an intermediate flow path flow rate.

In the second preferred embodiment the apparatus is further comprised of a flow path bypass for providing a bypass flow rate of the fluid through the flow path bypass. The flow control valve mechanism controls the bypass flow rate by selectively directing the fluid between the flow path bypass and the flow path. The flow path bypass may be external of the apparatus, but in the preferred embodiment the flow path bypass extends within the housing of the apparatus.

The flow path, the flow path bypass and the flow control valve mechanism are configured so that the first position of the flow control valve mechanism provides a minimum flow path flow rate and a maximum bypass flow rate, the second position of the flow control valve mechanism provides a maximum flow path flow rate and a minimum bypass flow rate, and the intermediate position of the flow control valve mechanism provides an intermediate flow path flow rate and an intermediate bypass flow rate.

In a first variant of the second preferred embodiment the flow control valve mechanism is comprised of a first flow control valve mechanism and a second flow control valve mechanism which are both actuatable by the actuator, preferably sequentially in order to provide the minimum pressure drop position, the intermediate pressure drop position and the maximum pressure drop position.

In the first variant of the second preferred embodiment the flow control mechanism is preferably actuated by applying a longitudinal movement to the flow control valve mechanism so that the first position is a first longitudinal position of the flow control valve mechanism, the intermediate position is an intermediate longitudinal position of the flow control valve mechanism, and the second position is a second longitudinal position of the flow control valve mechanism.

The first flow control valve mechanism is preferably comprised of a bypass port communicating with the flow path bypass and a longitudinally movable bypass port sealing member for sealing the bypass port. The second flow control valve mechanism is preferably comprised of a bypass nozzle communicating with the flow path bypass and a longitudinally movable bypass nozzle sealing member for sealing the bypass nozzle.

Neither the bypass port nor the bypass nozzle is sealed when the apparatus is in the minimum pressure drop position. One of the bypass port and the bypass nozzle is sealed when the apparatus is in the intermediate pressure drop position. Both of the bypass port and the bypass nozzle are sealed when the apparatus is in the maximum pressure drop position. In the preferred embodiment the bypass port is sealed when the apparatus is in the intermediate pressure drop position.

The bypass port sealing member is preferably comprised of a bypass port sealing sleeve and the bypass nozzle sealing member is preferably comprised of a bypass nozzle sealing sleeve. The sealing sleeves are preferably concentric and movable longitudinally relative to each other in order to define the first longitudinal position, the intermediate longitudinal position and the second longitudinal position of the flow control valve mechanism.

In a second variant of the second preferred embodiment the flow control valve mechanism is comprised of a first flow control valve member and a second flow control valve member, wherein the first flow control valve member and the second flow control valve member are rotatable relative to each other by the actuator in order to actuate the flow control valve mechanism between the first position, the second position, and preferably at least one intermediate position.

In the second variant of the second preferred embodiment the first flow control valve member is comprised of a primary first member bypass port and the second flow control valve member is comprised of a primary second member bypass port, and the flow control valve mechanism is actuated by rotating the first flow control valve member and the second flow control valve member relative to each other in order to selectively align and misalign the primary bypass ports. The primary bypass ports preferably each comprise a plurality of discrete apertures or ports.

Preferably the primary bypass ports are substantially aligned when the flow control valve mechanism is actuated to the first position, but the apparatus may alternatively be configured so that the primary bypass ports are substantially misaligned when the flow control valve mechanism is actuated to the first position.

Where the flow control valve mechanism is actuatable to an intermediate position, the first flow control valve member is preferably comprised of a secondary first member bypass port, the second flow control valve member is preferably comprised of a secondary second member bypass port, and the flow control valve mechanism is preferably actuated by rotating the first flow control valve member and the second flow control valve member relative to each other in order to selectively align and misalign the secondary bypass ports. The secondary bypass ports preferably each comprise a plurality of discrete apertures or ports.

Preferably the secondary bypass ports are substantially aligned when the flow control valve mechanism is actuated to the intermediate position, but the apparatus may alternatively be configured so that the secondary bypass ports are substantially misaligned when the flow control valve mechanism is actuated to the intermediate position.

In the second preferred embodiment the actuator may be comprised of any suitable structure, apparatus or device for effecting and maintaining the actuation of the flow control device.

For example, the actuator may be comprised of a single device which is manipulable both to move the flow control valve mechanism to a selected position and to maintain the flow control valve mechanism at the selected position. Alternatively, the actuator may be comprised of a device which is manipulable to move the flow control valve mechanism to a selected position and a separate device to hold the flow control valve mechanism at the selected position. The device for holding the flow control valve mechanism in the selected position may be comprised of a locking mechanism. The locking mechanism may be comprised of a J-slot assembly which is connected with the flow control device.

More preferably, however, the flow control device is actuated using an actuator similar to that described for the first preferred embodiment, including a mandrel or a sleeve for providing a longitudinal movement which is controlled and/or converted to rotational movement by a barrel cam and pin assembly. In other words, the actuator described for the first preferred embodiment may be adapted for use in either the first variant of the second preferred embodiment (by utilizing indexed longitudinal movement) or the second variant of the second preferred embodiment (by utilizing indexed rotational movement).

In a third preferred embodiment, the pressure drop device is comprised of a mixing device for providing a force to the fluid as it passes through the pressure drop device. In the third preferred embodiment, the mixing device is comprised of a pump. More particularly, in the third preferred embodiment the mixing device is comprised of a centrifugal pump which is positioned in the flow path.

In the third preferred embodiment, the actuator is comprised of a source of power for driving the mixing device. The source of power in the third preferred embodiment is a rotary drilling motor which in turn is powered by the fluid. As a result, in the third preferred embodiment, the mixing device provides energy to the fluid which has been generated by the fluid itself as it passes through the rotary drilling motor.

In the third preferred embodiment, the actuator is further comprised of a transmission for transmitting the power from the rotary drilling motor to the mixing device. The transmission is comprised of a shaft linking the rotary drilling motor and the mixing device and in the third preferred embodiment is further comprised of a gearing up gearbox. The gearing up gearbox increases the speed of rotation of the mixing device relative to the speed of rotation of the rotary drilling motor.

In the third preferred embodiment, the actuator is further comprised of a switch mechanism for activating and deactivating the source of power, which switch mechanism is controlled by a pressure exerted by the fluid on the switch mechanism. The switch mechanism is comprised of a piston which is movable longitudinally in response to pressure exerted on the piston by the fluid. In the third preferred embodiment, the longitudinal movement of the switch mechanism causes the fluid either to be directed through the rotary drilling motor, thus activating the source of power for the mixing device, or diverted from the rotary drilling motor, thus deactivating the source of power for the mixing device. As a result, in the third preferred embodiment, the operation of the actuator and the resulting actuation of the mixing device may be controlled by varying the pressure exerted by the fluid on the piston.

In the third preferred embodiment, the pressure drop device may be comprised of a plurality of devices. The plurality of devices may be configured in series to incrementally provide heat energy to the fluid. For example, the pressure drop device may be comprised of a plurality of mixing devices such as a plurality of pumps configured in series. The pumps may be powered by a single source of power or by separate sources of power.

Alternatively, the pressure drop device may be comprised of different types of devices configured together. For example, the pressure drop device may be comprised of one or more valve mechanisms and/or one or more non-actuatable pressure drop devices and/or one or more mixing devices.

In a variation of the third preferred embodiment, the pressure drop device is comprised of a plurality of valve mechanisms and/or non-actuatable devices configured in series and is further comprised of a mixing device which is configured in series relative to the other pressure drop devices. The mixing device may be utilized to provide heat energy to the fluid and may also be utilized to assist in recirculating the fluid to more efficiently and effectively provide heat to the fluid.

In all embodiments, the apparatus of the invention may be further comprised of a recirculation mechanism for recirculating at least a portion of the fluid, and the method of the invention may be further comprised of the step of recirculating at least a portion of the fluid. The fluid may be recirculated back through the flow path, may be recirculated adjacent to the flow path, or may even be recirculated in the borehole adjacent to the apparatus.

In one embodiment of a recirculation mechanism, the pressure drop device may be comprised of a secondary flow path which is positioned adjacent to the flow path and which permits the fluid to pass adjacent to the flow path in order to facilitate the additional provision of heat to the fluid without the fluid being recirculated through the flow path. In this embodiment, the wall of the flow path effectively functions as a heat exchanger by which heat may be provided by conduction from fluid contained in the flow path to fluid contained in the secondary flow path. The secondary flow path may be comprised of the borehole surrounding the apparatus or may be comprised of a passageway defined by the apparatus adjacent to the flow path. Preferably the secondary flow path is comprised of an annular passageway which surrounds the flow path, which annular passageway may be comprised either of the borehole or a passageway defined by the apparatus.

In a variation of this recirculation mechanism, the secondary flow path may facilitate the provision of heat by conduction from fluid contained in the secondary flow path to fluid contained in the flow path. The secondary flow path may be comprised of the borehole surrounding the apparatus or a passageway defined by the apparatus. This variation of the recirculation mechanism may increase the efficiency of the overall provision of heat to fluid passing through the flow path by providing counterflow thermal conduction between heated fluid being passed upwardly in the borehole relative to the apparatus after exiting the apparatus and fluid being passed downward through the apparatus.

The recirculation of the fluid may be carried out in any suitable manner using any suitable structure, apparatus or device. For example, the fluid may be recirculated entirely within the apparatus or may be recirculated partly within the apparatus and partly within the borehole.

In order to provide for recirculation, the apparatus of the invention may be provided with at least one outlet port and at least one recirculation port. The outlet port permits the fluid to exit the apparatus and the recirculation port enables the fluid to reenter the apparatus.

The outlet port may communicate with a downstream side of the pressure drop device and the recirculation port may communicate with an upstream side of the pressure drop device.

Alternatively, in some embodiments, including the embodiment in which the pressure drop device is comprised of a secondary flow path, the outlet port may communicate with a downstream side of both the flow path and the secondary flow path and the recirculation port may communicate with an upstream side of the secondary flow path. The secondary flow path may be configured co-currently with the flow path so that the upstream side of the secondary flow path is adjacent to the upstream side of the flow path, or the secondary flow path may be configured counter-currently so that the upstream side of the secondary flow path is adjacent to the downstream side of the flow path.

The upstream and downstream sides of the pressure drop device may be located at or adjacent to the extreme ends of the pressure drop device or may be located to be relatively upstream and relatively downstream. Similarly, the upstream and downstream sides of the secondary flow path may be located at or adjacent to the extreme ends of the secondary flow path or may be located to be relatively upstream and relatively downstream.

Any suitable configuration may be used to recirculate the fluid.

As a first exemplary recirculation configuration, the apparatus may be comprised of a recirculation flow path extending between the outlet port and the recirculation port, whereby the fluid can be recirculated within the apparatus from the downstream side of the pressure drop device back to the upstream side of the pressure drop device without being exposed to the borehole. This configuration provides the potential advantage of recirculating relatively clean fluid which has not been contaminated by the borehole.

As a second exemplary recirculation configuration, the outlet port and the recirculation port may communicate directly or indirectly with the borehole so that the fluid can be recirculated within the borehole from the downstream side of the pressure drop device back to the upstream side of the pressure drop device. This configuration provides the potential advantage of contacting the fluid with the borehole while it is being circulated, thus potentially providing heat to the borehole during the recirculation process.

As a third exemplary recirculation configuration, the apparatus may be comprised of both a recirculation flow path and a secondary flow path extending between the outlet port and the recirculation port, whereby the fluid can be recirculated within the apparatus from the downstream side of the pressure drop device and/or the secondary flow path back to the upstream side of the secondary flow path and then back through the secondary flow path without being exposed to the borehole. This configuration provides the potential advantage of recirculating relatively clean fluid which has not been contaminated by the borehole.

As a fourth exemplary recirculation configuration, the outlet port and the recirculation port may communicate directly or indirectly with the borehole and a secondary flow path may also extend between the outlet port and the recirculation port so that the fluid can be recirculated within the borehole from the downstream side of the pressure drop device and/or the secondary flow path back to the upstream side of the secondary flow path and then back through the secondary flow path. This configuration provides the potential advantage of contacting the fluid with the borehole while it is being circulated, thus potentially providing heat to the borehole during the recirculation process.

In the embodiments in which the pressure drop device is comprised of a secondary flow path, the pressure drop device may be further comprised of a plurality of devices such as valve mechanisms, non-actuatable devices and/or mixing devices.

For example, a pressure drop device may be positioned in the flow path and a separate pressure drop device may be positioned in the secondary flow path. In one preferred embodiment, a valve mechanism as in the first preferred embodiment or a non-actuatable device as in the second preferred embodiment may be positioned in the flow path and a mixing device as in the third preferred embodiment may be positioned in the secondary flow path. In this embodiment, the mixing device positioned in the secondary flow path may be utilized both to provide heat to the fluid and to assist in the recirculation between the outlet port and the recirculation port.

SUMMARY OF DRAWINGS

Embodiments of the invention will now be described with reference to the accompanying drawings, in which.

DETAILED DESCRIPTION

Figure 1A:
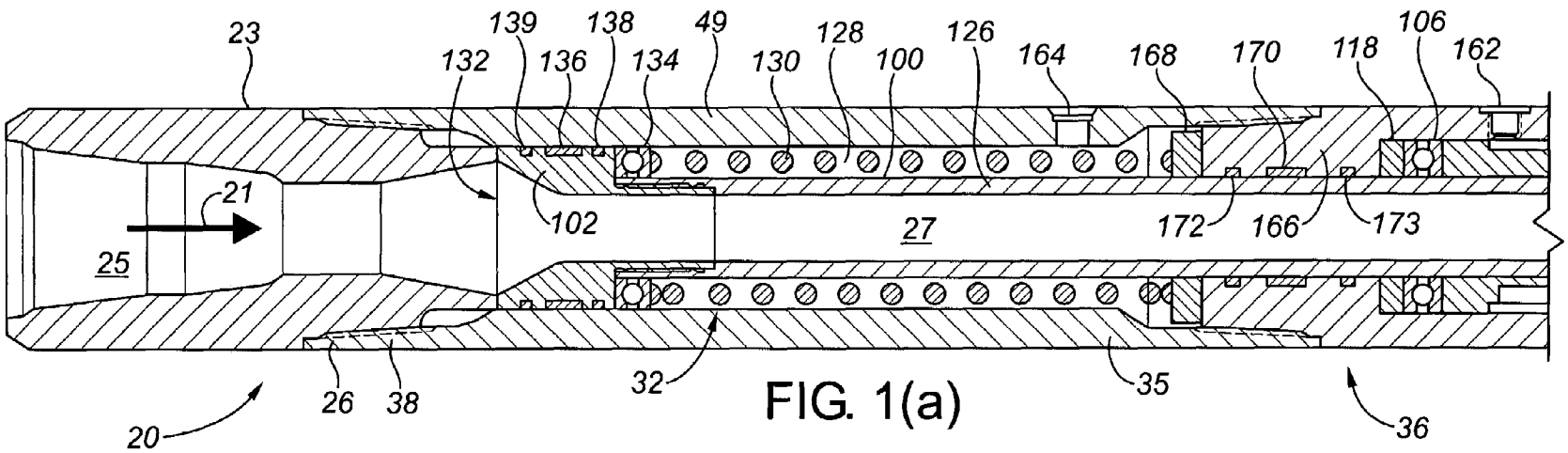
FIGS. 1(*a*) through 1(*d*) are a longitudinal sectional view of a preferred embodiment of an apparatus according to the invention which includes a valve mechanism as a pressure drop device, wherein FIGS. 1(*b*) through 1(*d*) are down hole continuations of FIGS. 1(*a*) through (1(*c*) respectively.
Figure 1B:
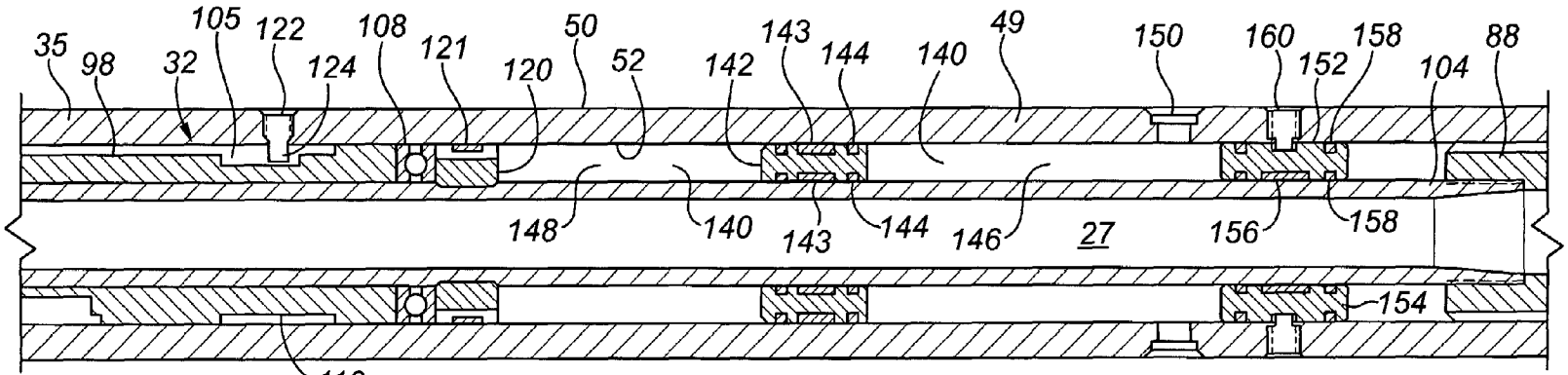
Figure 1C:
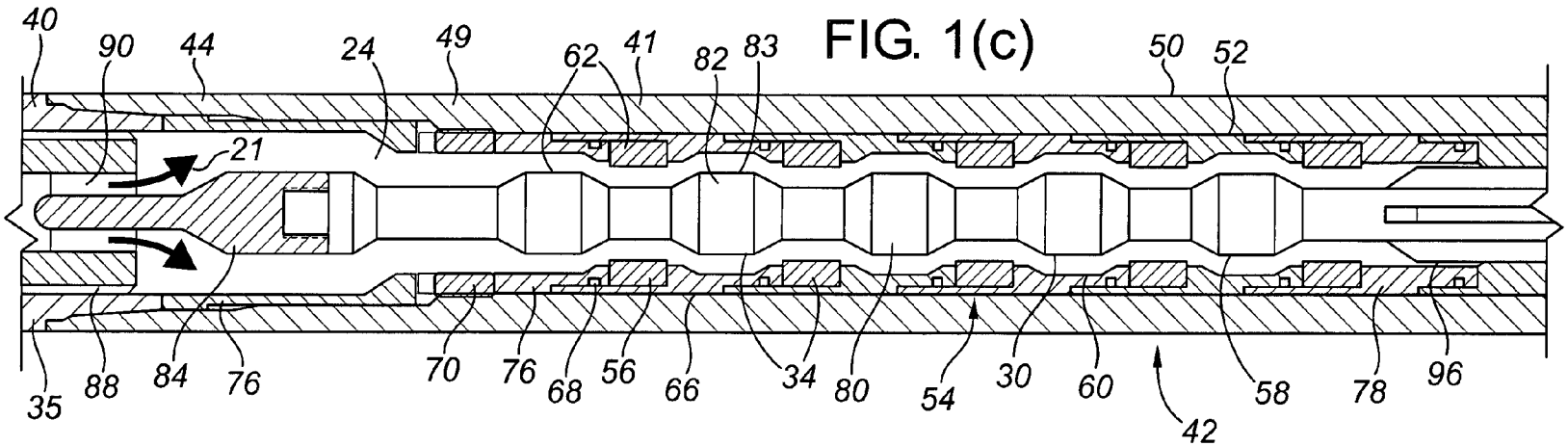
Figure 1D:
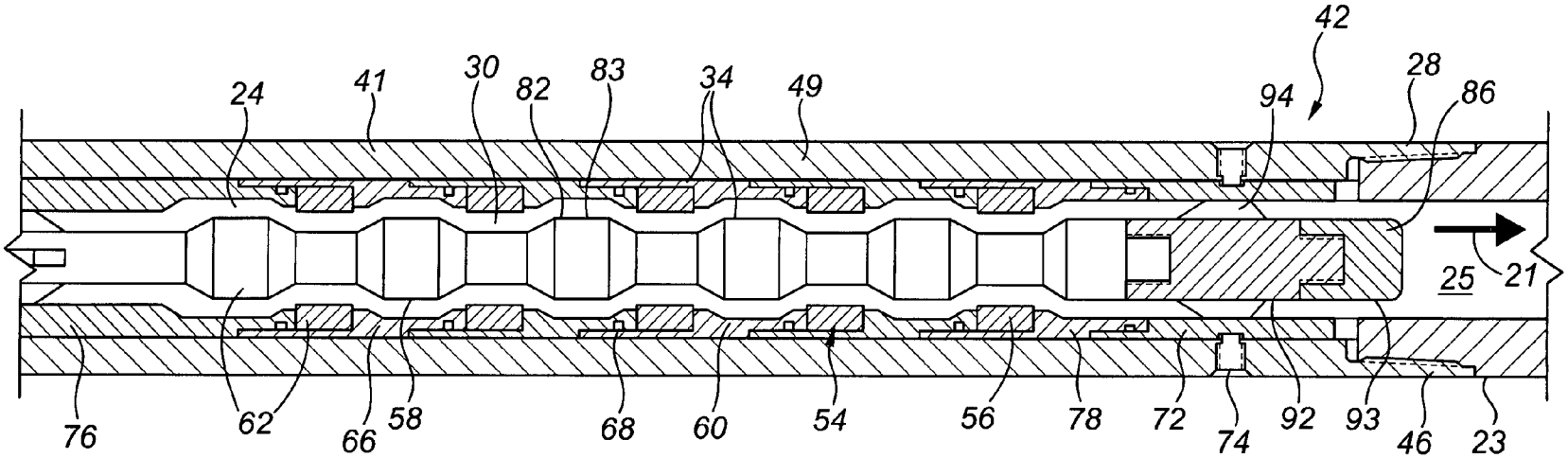

Referring to FIGS. 1, 7, 8, 9 and 10, the apparatus (20) of the present invention is provided for providing heat energy to a fluid (21). More particularly, the fluid (21) is preferably a drilling fluid, which may be comprised of a gas, a liquid or a combination thereof, which is conducted or pumped from the surface into a borehole (29) being drilled in a desired underground formation. Typically, the drilling fluid is referred to as a drilling fluid and may be comprised of any fluid capable of and suitable for use in the drilling operation.

The apparatus (20) is connected into a working string, preferably a drill string (23) which extends from the surface down hole to a drill bit (22) for performing the drilling operation. The apparatus (20) may be incorporated into or integrated with other components of the drill string (23). Alternately, the apparatus (20) may be comprised of a separate sub or tubular component connected with or into the drill string (23) such that it forms a portion thereof.

The drill string (23) defines a drill string bore (25) therethrough for conducting the fluid (21). The apparatus (20) includes an apparatus bore (27) and a flow path (24) which communicate with each other and with the drill string bore (25). The flow path (24) may be comprised of a portion or continuation of the apparatus bore (27) or the flow path (24) may be comprised of a branch or diversion from the apparatus bore (27).

Accordingly, the apparatus (20) is connected with or into the other components of the drill string (23) such that the apparatus (20) provides a continuation of the drill string bore (25) in order to permit the fluid (21) to be pumped from the surface down hole to the bottom of the drill bit (22). Further, the drill string (23) typically extends from the surface through one or more casing strings, liners and/or other tubular members or pipe segments (not shown), including a surface casing string and other intermediate casing strings, liners and/or tubular members as required, and exits therefrom to an uncased or open portion of a borehole (29) being drilled.

Thus, during the drilling operation, the fluid (21) is circulated from the surface through the drill string bore (25), the apparatus bore (27) and the flow path (24) to the drill bit (22) and into the open portion of the borehole (29). The fluid (21) is then circulated back to the surface in an annulus defined between the drill string (23) and the adjacent wall of the borehole (29) and subsequently between the drill string (23) and the casing string, liner or other tubular member. The fluid (21) is used to perform a variety of down hole functions such as actuation of a down hole drilling motor, lubrication of the drill bit, removal of any undesirable debris from the borehole (29) and control or stabilization of the formation.

When the apparatus (20) is connected into the drill string (23), the hydraulic energy of the fluid (21) being pumped from the surface and through the apparatus (20) is dissipated, in part, as heat by the apparatus (20) to increase the temperature of the fluid (21) which subsequently exits the drill string (23) through the drill bit (22). As a result, the heated fluid (21) contacts the formation in an uncased or open portion of the borehole (29). While a portion of the hydraulic energy is dissipated as heat, the fluid (21) must have sufficient hydraulic energy down hole of the apparatus (20) to effectively operate or actuate any further down hole equipment such as a drilling motor.

Thus, the apparatus (20) is designed for the purpose of heating the fluid (21) as it flows through the flow path (24). The fluid (21) is heated either by generating an energy conversion or by generating an energy loss in the form of heat energy. In the preferred embodiments, the apparatus (20) converts hydraulic energy of the fluid (21) into heat as the fluid (21) passes through the apparatus (20).

The apparatus (20) may be connected into the drill string (23) at any position or location along the length of the drill string (23). However, preferably the apparatus (20) is adapted to form a part or portion of a bottomhole assembly ("BHA") comprising the drill string (23).

The apparatus (20) is preferably positioned down hole near the bottom or down hole end of the drill string (23) or BHA so that the heat creation occurs at or near the down hole end of the drill string (23). As a result, heat losses may be avoided which can occur when heated fluid (21), heated at or near the surface, is transmitted from the surface down hole.

Care should be taken in locating the apparatus (20) within the drill string (23) when the BHA includes a measurement-while-drilling (MWD) communication system (not shown), particularly a fluid pulse MWD system. Where the BHA includes a negative pulse MWD system, the apparatus (20) is preferably connected into the drill string (23) above the MWD system in order to avoid over-pressurization of the MWD valving. Where the BHA includes a positive pulse MWD system, the apparatus (20) may be connected either above or below the MWD system, since the pressure pulses generated by the MWD system are relative to the pressure within the drill string (23). It is generally, however, preferable to connect the apparatus (20) into the drill string (23) above the MWD system so that the apparatus (20) does not lengthen the distance between the MWD system and the drill bit (22).

The drill string (23) may be provided and utilized for either rotary drilling or sliding drilling. Thus, for rotary drilling, the drill string (23) including the apparatus (20) may be rotated from the surface for rotating the drill bit (22) down hole. Alternately, for sliding drilling, the drill string (23) may be comprised of a down hole drilling motor for rotating the drill bit (22). In this case, the apparatus (20) is preferably connected into the drill string (23) at a position up hole of the down hole drilling motor such that the fluid (21) pumped from the surface passes through the flow path (24) prior to passing within or through the motor to the drill bit (22).

The drill string (23) may be comprised of any tubing or tubular members suitable for use in either rotary or sliding drilling, as desired, such as jointed drill pipe, coiled tubing or a combination thereof.

The apparatus (20) includes an upper end (26) and a lower end (28). Any means or mechanism may be provided at the upper and lower ends (26, 28) for connecting the apparatus (20) into the drill string (23). However, preferably a threaded connection or threaded connector, such as compatible threaded box and pin components, is provided between the apparatus (20) and the other components of the drill string (23) at each of the upper and lower ends (26, 28) of the apparatus (20).

As described herein, the apparatus (20) is connected into the drill string (23) such that the upper end (26) of the apparatus (20) is nearer the surface of the borehole than the lower end (28), and correspondingly, the lower end (28) is nearer the drill bit (22) than the upper end (26). However, it should be noted that the apparatus (20) may be adapted to be connected into the drill string (23) in a reverse or opposite manner. In other words, the apparatus (20) may be connected into the drill string (23) such that the lower end (28) is nearer the surface of the borehole while the upper end (26) is nearer the drill bit (22).

Referring to FIGS. 1, 7, 8 and 9, the apparatus (20) is further comprised of a pressure drop device (30) and an actuator (32). The pressure drop device (30) is positioned within the flow path (24) of the apparatus (20). The pressure drop device (30) may be comprised of any type or configuration of device, structure or apparatus which is capable of generating an energy conversion or an energy loss in the form of heat energy, which heat energy may be provided to the fluid as it passes through the apparatus (20).

For example, the pressure drop device (30) may be comprised of a mechanism or device for mixing or shearing the fluid (21) passing therethrough, such as a high shear mixing device, a turbine or a pump such as a centrifugal pump.

FIGS. 1-5 depict a first preferred embodiment of the apparatus (20) of the invention. In the first preferred embodiment, the pressure drop device (30) is comprised of at least one valve mechanism (34) actuatable by the actuator (32) in order to actuate the apparatus (20) between a minimum pressure drop position, a maximum pressure drop position and preferably at least one intermediate pressure drop position. More preferably, the pressure drop device (30) is comprised of a plurality of valve mechanisms (34) actuatable by the actuator (32) in order to actuate the apparatus (20) between the minimum pressure drop position, the maximum pressure drop position and preferably at least one intermediate pressure drop position. The actuator (32) is provided for actuating the valve mechanisms (34) and thus the apparatus (20). The valve mechanisms (34) provide a variable flow restriction and/or a variable tortuous path through the flow path (24) which is varied as a result of actuation of the valve mechanisms (34) by the actuator (32).

In the first preferred embodiment of FIGS. 1-5, the actuator (32) specifically actuates each valve mechanism (34) to alter the flow path (24). Preferably, the actuator (32) actuates each valve mechanism (34) between a plurality of settings or predetermined positions, referred to herein as pressure drop positions, to vary the amount or degree of restriction of the flow of the fluid (21) through the apparatus (20). Specifically, the actuator (32) actuates each valve mechanism (34) between the minimum pressure drop position and the maximum pressure drop position.

In addition, the actuator (32) is preferably capable of actuating each valve mechanism (34) to at least one intermediate pressure drop position. One or more intermediate pressure drop position permit finer tuning or control over the amount of the pressure drop and the corresponding temperature increase. In addition, an intermediate pressure drop position may provide a safety factor or back-up feature in the event that the fluid pumps at the surface are not capable of providing a desired flow rate of the fluid (21) from the surface when the valve mechanisms (34) are in the maximum pressure drop position. In this case, the intermediate pressure drop position may allow for higher flow rates with substantially the same amount of heat generation.

The actuator (32) may be controlled and operated to actuate the valve mechanisms (34) between the different pressure drop positions in any manner and by any compatible mechanism. For instance, the actuator (32) may be controlled mechanically, hydraulically or electrically by any suitable mechanism capable of operating the actuator (32) in the desired manner. However, preferably, the actuator (32) is controlled by a pressure exerted by the fluid (21) on the actuator (32) to move the valve mechanisms (34) between the different pressure drop positions. Thus, a fluid pump or alternate fluid control system or mechanism is provided at the surface for providing the necessary pressure of the fluid (21) down hole to control the actuator (32) so that the actuator (32) may be controlled to actuate the valve mechanisms (34) between the pressure drop positions by a simple series of on-off fluid pump cycles or by cycling the fluid (21) flow above and below a predetermined pressure threshold and/or a predetermined fluid flow rate.

Figure 2:
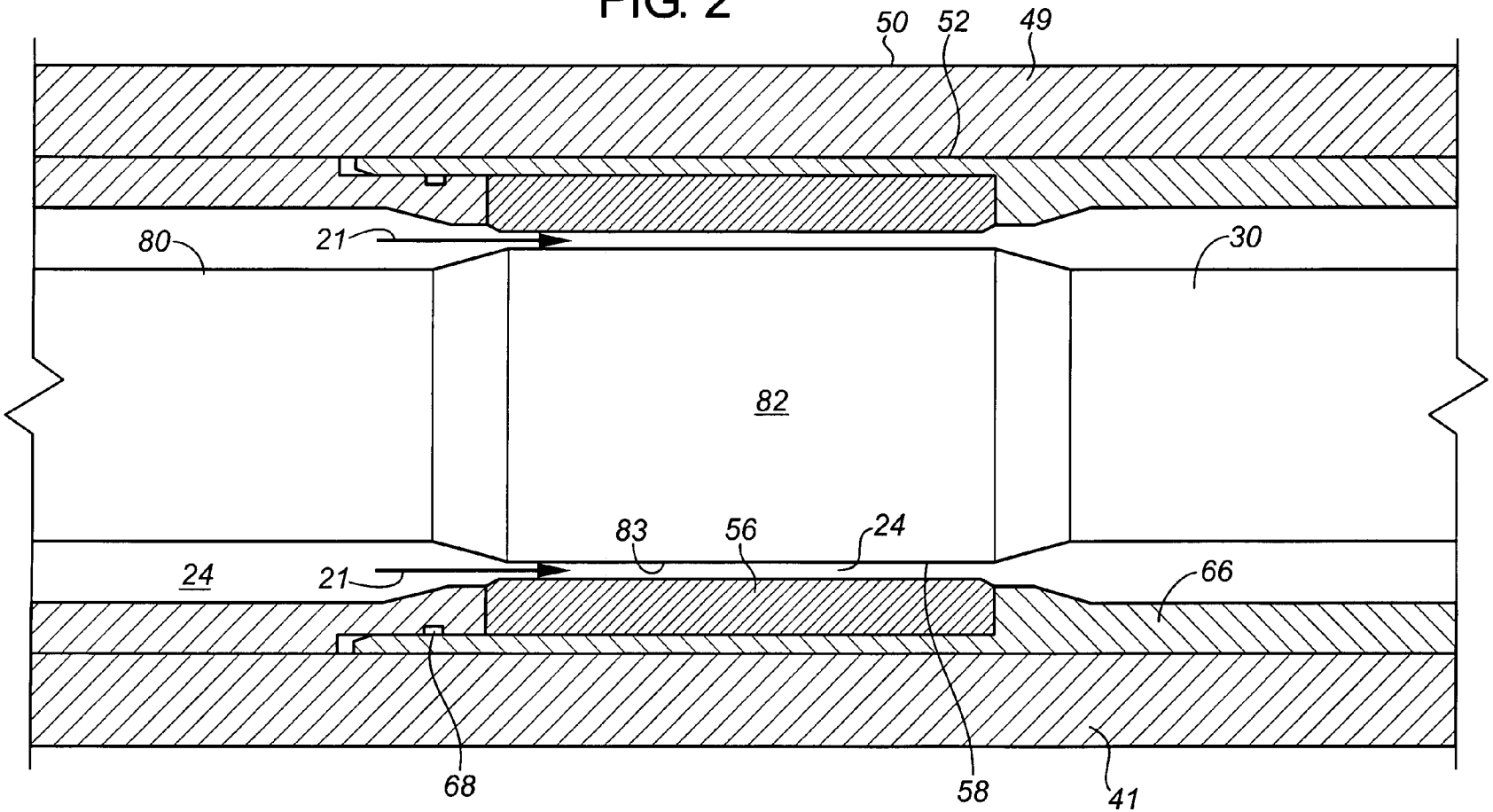
FIG. 2 is a detailed longitudinal sectional view of a portion of a preferred embodiment of a valve mechanism for use in the embodiment of the apparatus depicted in FIG. 1, wherein the valve mechanism is depicted as actuated to a position corresponding to the maximum pressure drop position of the apparatus.
Figure 3:
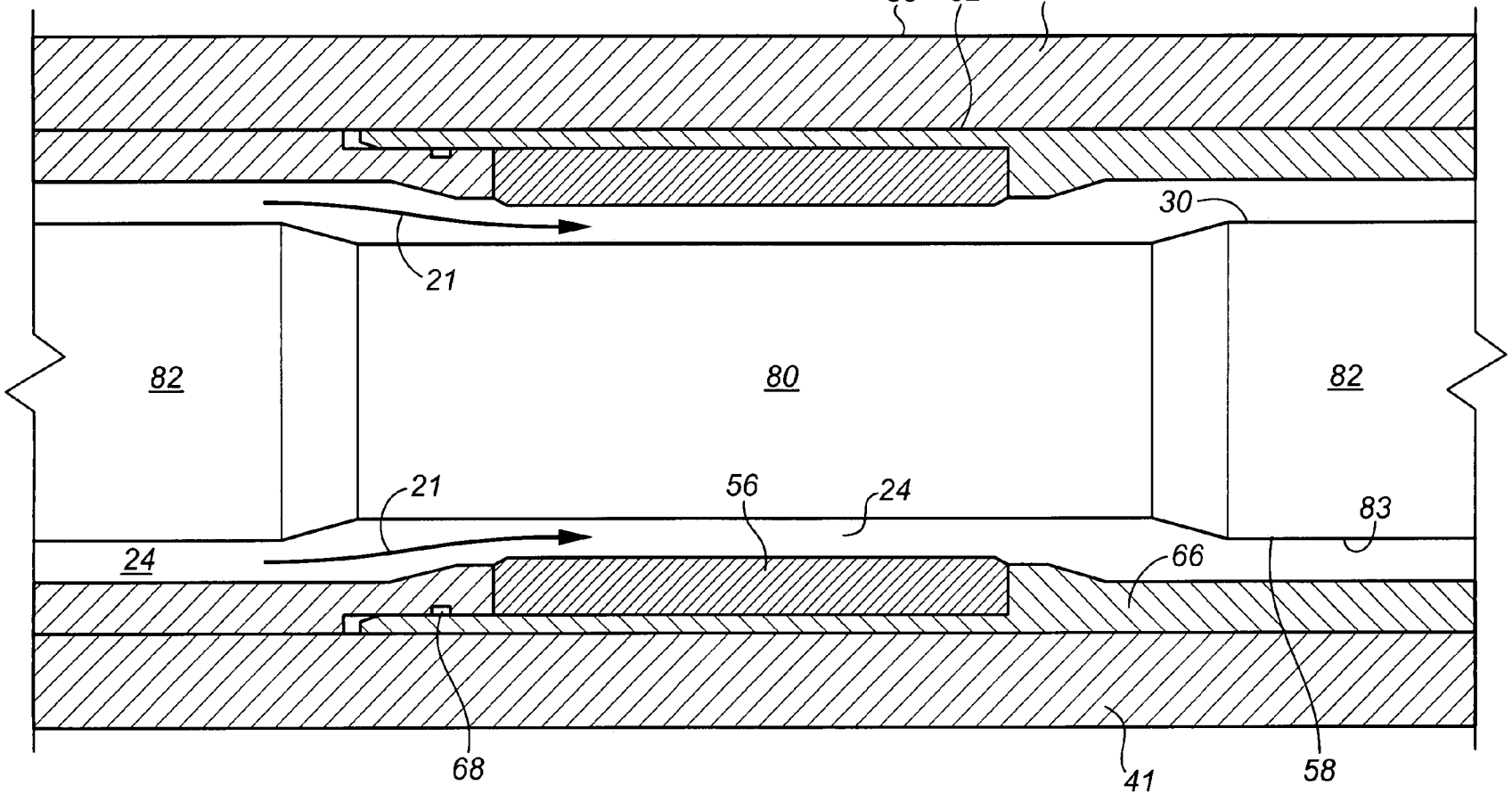
FIG. 3 is a detailed longitudinal sectional view of the portion of the preferred embodiment of the valve mechanism depicted in FIG. 2, wherein the valve mechanism is depicted as actuated to a position corresponding to the minimum pressure drop position of the apparatus.

Referring to FIGS. 1-3, the apparatus (20) of the first preferred embodiment is comprised of a first section (35). The first section (35) defines an actuator sub assembly (36) and the apparatus bore (27) and the actuator (32) is positioned within the actuator sub assembly (36). The actuator sub assembly (36) has an upper end (38) and a lower end (40). The apparatus (20) is further comprised of a second section (41). The second section (41) defines a pressure drop sub assembly (42) and the valve mechanisms (34) are positioned within the pressure drop sub assembly (42). The pressure drop sub assembly (42) has an upper end (44) and a lower end (46) and includes the flow path (24) as a continuation of the apparatus bore (27). Alternatively, the pressure drop sub assembly (42) may also include a continuation of the apparatus bore (27) which is separate from the flow path (24) so that only a portion of the fluid (21) passes through the flow path (24).

The first and second sections (35, 41) of the apparatus (20) defining the actuator sub assembly (36) and the pressure drop sub assembly (42) respectively may be removably or fixedly connected together in any manner. Preferably they are removably connected together with a threaded connection.

Further, the assemblies (42, 36) are preferably connected such that the pressure drop sub assembly (42) is located down hole of the actuator sub assembly (36). Thus, the actuator (32) is exposed to the flow of the fluid (21) passing from the drill string bore (25) up hole of the apparatus (20). However, alternately, the apparatus (20) may be connected into the drill string (23) in a reverse or upside down orientation. Thus, the pressure drop sub assembly (42) may be located up hole of the actuator sub assembly (36) if sufficient pressure can be provided within the actuator sub assembly (36) to actuate the actuator (32) in the reverse orientation.

Thus, in the first preferred embodiment, the upper end (38) of the actuator sub assembly (36) defines the upper end (26) of the apparatus (20) and is threadably connected with the up hole portion or components of the drill string (23). The lower end (40) of the actuator sub assembly (36) is threadably connected with the upper end (44) of the pressure drop sub assembly (42). The actuator sub assembly (36) and the pressure drop sub assembly (42) are connected in a manner permitting the fluid (21) to communicate therebetween to provide a continuous fluid path through the apparatus (20). Finally, the lower end (46) of the pressure drop sub assembly (42) defines the lower end (28) of the apparatus (20) and is threadably connected with the down hole portion or components of the drill string (23).

The pressure drop sub assembly (42) and the actuator sub assembly (36) collectively define a housing (49) of the apparatus (20), which housing (49) has an outer surface (50) and an inner surface (52).

In the first preferred embodiment, the pressure drop sub assembly (42) is comprised of the pressure drop device (30) and the flow path (24) and the pressure drop device (30) is positioned within the flow path (24). The pressure drop device (30) is comprised of a plurality of valve mechanisms (34). Any type or configuration of valve mechanism (34) may be utilized which is able to control or alter the flow of the fluid (21) through the flow path (24) in order to achieve the desired provision of heat to the fluid (21). In the preferred embodiment, each of the valve mechanisms (34) is comprised of a flow restrictor device (54).

More particularly, each valve mechanism (34) is comprised of an orifice (56) and a corresponding compatible flow restrictor member (58). The flow restrictor member (58) is positioned relative to the orifice (56) in order to adjust the flow path (24). More particularly, movement of the flow restrictor member (58) relative to the orifice (56) adjusts the cross-sectional area of the flow path (24). The relative dimensions of the orifice (56) and the flow restrictor member (58) are selected to provide the desired energy loss as the fluid (21) flows therethrough.

The plurality of valve mechanisms (34) are configured or connected in series or stacked to permit a staged pressure drop across the complete pressure drop device (30). Accordingly, a plurality of orifices (56) and a corresponding plurality of flow restrictor members (58) are connected in series or stacked together. The number of valve mechanisms (34), each having an orifice (56) and a compatible flow restrictor member (58), is selected to provide the desired pressure drop or energy loss as the fluid (21) flows through the valve mechanisms (34).

Referring to FIGS. 1-3, in the first preferred embodiment, the valve mechanisms (34) are comprised of an orifice assembly (60), which may also be referred to as an orifice sleeve stack, fixedly mounted within the inner surface (52) of the housing (49). The orifice assembly (60) defines the flow path (24) through the second section (41) of the apparatus (20).

The orifice assembly (60) is comprised of a plurality of orifice stages (62). Each orifice stage (62) is comprised of an orifice (56) and a compatible corresponding orifice retainer (66) which may also be referred to as an orifice sleeve. More particularly, the orifice retainers (66) are adapted and configured to fit together or be stacked such that the orifice retainers (66) are engaged end to end in a manner permitting the orifice (56) to be secured in position between two adjacent orifice retainers (66). Thus each orifice (56) is held between two opposed shoulders of the immediately adjacent orifice retainers (66). Further, the adjacent orifice retainers (66) may be sealingly engaged with each other by a seal (68) or other sealing mechanism. Thus, when interconnected or stacked, the orifice retainers (66) define the orifice assembly (60) which extends for substantially the length of the second section (41) of the apparatus (20).

The number of orifice stages (62) comprising the orifice assembly (60) is selected to provide a desired pressure drop through the apparatus (20). The purpose of using a plurality of orifice stages (62) is to minimize the required velocity of the flow of fluid (21) while still creating enough or sufficient fluid shear over the length of the orifice assembly (60) to create the required energy loss and provision of heat. As the number of orifice stages (62) is reduced, the required velocity of the flow of fluid (21) to achieve a desired pressure drop is increased, with the result that the internal components of the orifice stage (62) may be subjected to substantial erosion which could reduce the life of the apparatus (20).

In the first preferred embodiment, as shown in FIGS. 1-5, ten orifice stages (62) are provided comprised of ten orifices (56) and ten corresponding orifice retainers (66). The orifice assembly (60) comprised of the orifice stages (62) may be held in position within the apparatus (20) by any retaining mechanism or structure capable of fixedly securing the orifice stages (62) within the inner surface (52) of the housing (49). Preferably, the orifice stages (62) are retained in position between an upper lock nut (70) positioned adjacent the uppermost or most up hole orifice stage (62) and an end sleeve or retainer (72) positioned adjacent the lowermost or most down hole orifice (62), which end sleeve (72) is preferably secured to the housing (49) by at least one retaining bolt (74) or other fastener. Where desired or required to achieve the desired spacing or positioning of the orifice stages (62), the orifice assembly (60) may be comprised of one or more spacer sleeves (76). Further, in order to properly connect with adjacent structures, one or more of the orifice retainers (66) may be configured as a crossover adapter (78) for connection with the adjacent structure.

In addition, the valve mechanisms (34) are comprised of a poppet shaft (80), which may be referred to as a poppet mandrel, extending within the orifice assembly (60) and configured to be compatible therewith. In particular, the poppet shaft (80) defines a plurality of the flow restrictor members (58) or upsets. In the preferred embodiment, each flow restrictor member (58) is comprised of a poppet (82) or alternate circumferential enlargement. The poppets (82) may be integrally formed with the poppet shaft (80) or may be removably connected or affixed thereto, such as with a threaded connection, to permit the removal of the poppet (82) in the event that it becomes eroded or worn from use.

Further, the poppet shaft (80) may be comprised of a hollow shaft in order to decrease its weight if necessary. The decreased weight may facilitate the operation of the actuator (32) to actuate and move the poppet shaft (80) operatively connected thereto, as described below. In addition, the poppet shaft (80) preferably has a coating of a wear-resistant material such as carbide in order to reduce or inhibit erosion of the poppet shaft (80). Similarly, each orifice (56) is preferably comprised of a solid carbide or other wear-resistant material to reduce or inhibit erosion.

Thus, the poppet shaft (80) is comprised of a plurality of poppets (82) along its length which are positioned adjacent the orifices (56) of the orifice assembly (60). Specifically, a single poppet (82) is provided to correspond with each orifice (56). More particularly, each poppet (82) has a poppet face (83) compatible with a corresponding orifice (56). Thus, in the preferred embodiment, ten poppets (82) are spaced apart along the length of the poppet shaft (80) from an upper end (84) of the poppet shaft (80) to a lower end (86) of the poppet shaft (80).

The poppet shaft (80) is mounted within the orifice assembly (60) in a manner permitting the longitudinal or axial movement of the poppet shaft (80) relative to the orifice assembly (60). Longitudinal or axial movement of the poppet shaft (80) permits the poppet face (83) of each poppet (82) along the poppet shaft (80) to move nearer or farther away from its respective corresponding orifice (56), thus adjusting the cross-sectional area of the flow path (24).

Accordingly, the relative longitudinal movement of the poppet shaft (80) actuates the valve mechanisms (34) and provides or permits the apparatus (20) to be moved between a minimum pressure drop position and a maximum pressure drop position. In the minimum pressure drop position, a maximum cross-sectional area of the flow path (24) is provided by the relative positions of each poppet (82) and corresponding orifice (56). In the maximum pressure drop position, a minimum cross-sectional area of the flow path (24) is provided by the relative positions of each poppet (82) and corresponding orifice (56).

Each poppet (82) and its corresponding orifice (56) are configured to provide a desired pressure drop in each of the minimum and maximum pressure drop positions. Further, each orifice stage (62) is further comprised of the corresponding poppet (82) cooperating therewith. As a result, each orifice stage (62) is configured to provide a desired pressure drop and the number of orifice stages (62) is selected to provide a desired total pressure drop or pressure drop difference between the maximum and minimum pressure drop positions. Preferably, each orifice stage (62) is configured to provide a pressure drop of about 25-500 psi (about 172.375 kPa-3447.5 kPa). In the referred embodiment, each orifice stage (62) is configured to provide a pressure drop of about 150-300 psi (about 1034.25-2068.5 kPa), and preferably about 200 psi (about 1379 kPa).

The upper end (84) of the poppet shaft (80) is comprised of, or is removably or fixedly connected with, a poppet shaft connector (88) which serves several purposes. First, the poppet shaft connector (88) facilitates the centralization and stabilization of the poppet shaft (80) within the orifice assembly (60). In other words, the poppet shaft connector (88) maintains or assists in maintaining the upper end (84) of the poppet shaft (80) in a substantially central position within the orifice assembly (60). Second the poppet shaft connector (88) acts to direct or divert the fluid (21) into the flow path (24) through the second section (41) of the apparatus (20). Specifically, the flow path (24) in the second section (41) is defined by the space between an outer surface of the poppet shaft (80) and an adjacent inner surface of the orifice assembly (60). Thus, the poppet shaft connector (88) defines one or more fluid channels (90) therethrough for directing or diverting the fluid (21) from the actuator sub assembly (35) into the space defining the flow path (24) through the pressure drop sub assembly (42). Third, the poppet shaft connector (88) provides a mechanism for operatively connecting or fastening the poppet shaft (80) with the actuator (32) such that the actuator is capable of moving the poppet shaft (80) longitudinally axially between the pressure drop positions.

The lower end (86) of the poppet shaft (80) is also preferably centralized and stabilized within the orifice assembly (60) to inhibit vibration of the poppet shaft (80). Thus, the lower end (86) of the poppet shaft (80) is preferably comprised of, or removably or fixedly connected with, a centralizer (92). The centralizer (92) is comprised of an end cap (93) at its lowermost or most down hole end. Further, the centralizer (92) is comprised of a plurality of centralizing ribs (94) spaced about the circumference of the centralizer (94) for slidingly or movably engaging the adjacent inner surface of the orifice assembly (60) to maintain or assist in maintaining the poppet shaft (80) in a substantially central position within the orifice assembly (60) and to reduce any vibration thereof. More particularly, the centralizing ribs (94) engage or contact the adjacent surface of the end sleeve (72) of the orifice assembly (60).

Finally, depending upon the length of the poppet shaft (80), further centralization and stabilization of the poppet shaft (80) to inhibit vibration of the poppet shaft (80) may be desired at an intermediate position along its length between its upper and lower ends (84, 86). In the preferred embodiment, a central portion of the poppet shaft (80) may be comprised of a plurality of further centralizing ribs (96) spaced about the circumference of the poppet shaft (80) for slidingly or movably engaging the adjacent inner surface of the orifice assembly (60) to maintain or assist in maintaining the poppet shaft (80) in a substantially central position within the orifice assembly (60) and to reduce vibration of the poppet shaft (80). Although the centralizing ribs (96) may be positioned at any location along the length of the poppet shaft (80), the centralizing ribs (96) are preferably substantially centrally placed. For instance, in the preferred embodiment, an equal number of orifice stages (62) are located on either side of the centralizing ribs (96). Further, the centralizing ribs (96) engage or contact the adjacent surface of a spacer sleeve (76), which may also be referred to as a centralizing sleeve.

FIGS. 2 and 3 show a closer or more detailed view of single poppet (82) in relation to its corresponding orifice (56) in the preferred embodiment. Specifically, the flow path (24) is restricted in a manner providing for a "straight restriction" wherein the adjacent surfaces of the poppet face (83) and the orifice (56), and thus the flow path (24) therebetween, are aligned substantially parallel with the longitudinal axis of the apparatus (20). FIG. 2 shows the valve mechanisms (34) comprising the pressure drop device (30) in the maximum pressure drop position wherein the cross-sectional area of the flow path (24) is at a minimum. FIG. 3 shows the valve mechanisms (34) comprising the pressure drop device (30) in the minimum pressure drop position wherein the cross-sectional area of the flow path (24) is at a maximum.

Figure 4:
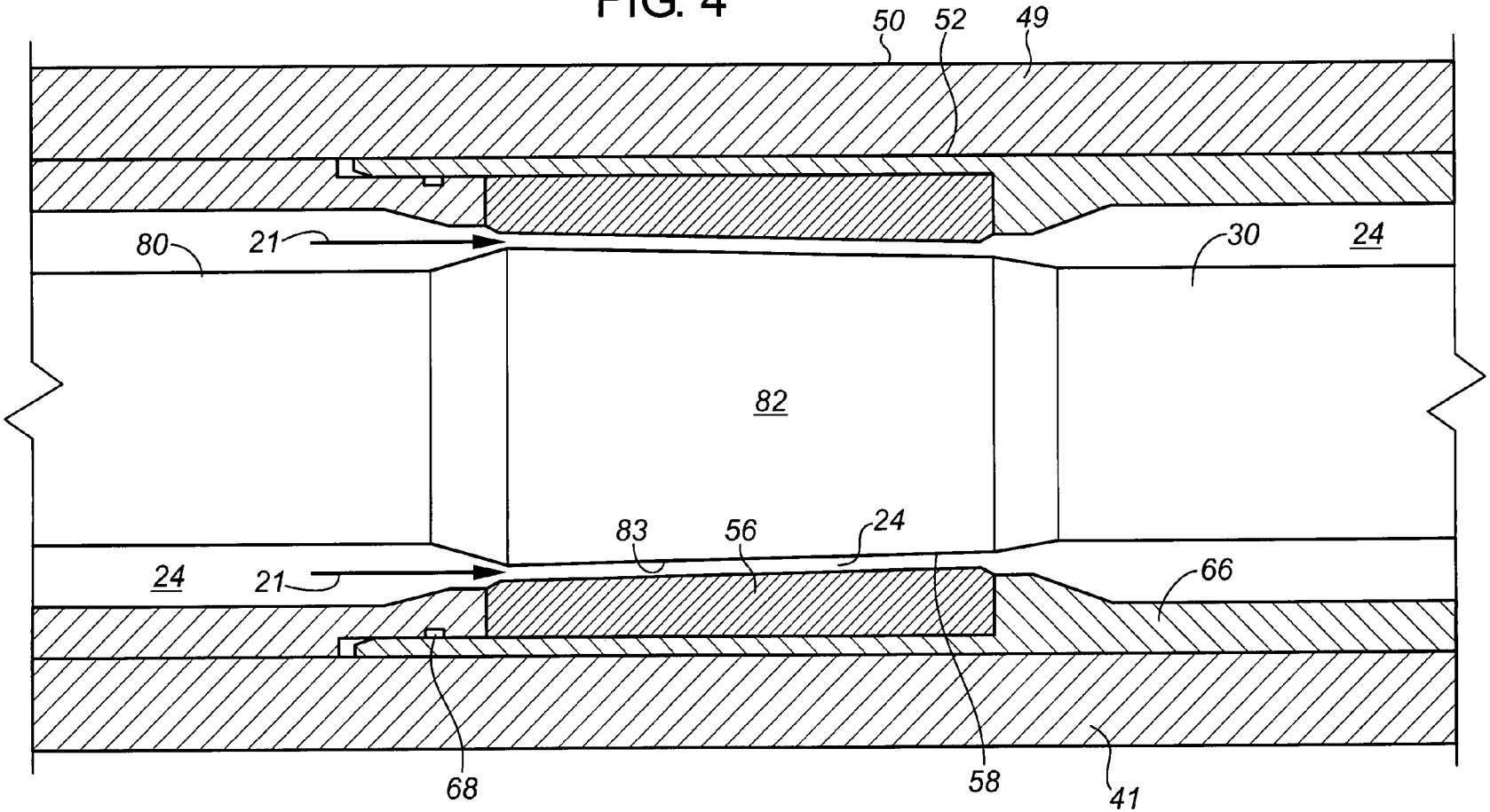
FIG. 4 is a detailed longitudinal sectional view of a portion of an alternate embodiment of a valve mechanism for use in the embodiment of the apparatus depicted in FIG. 1, wherein the valve mechanism is depicted as actuated to a position corresponding to the maximum pressure drop position of the apparatus.
Figure 5:
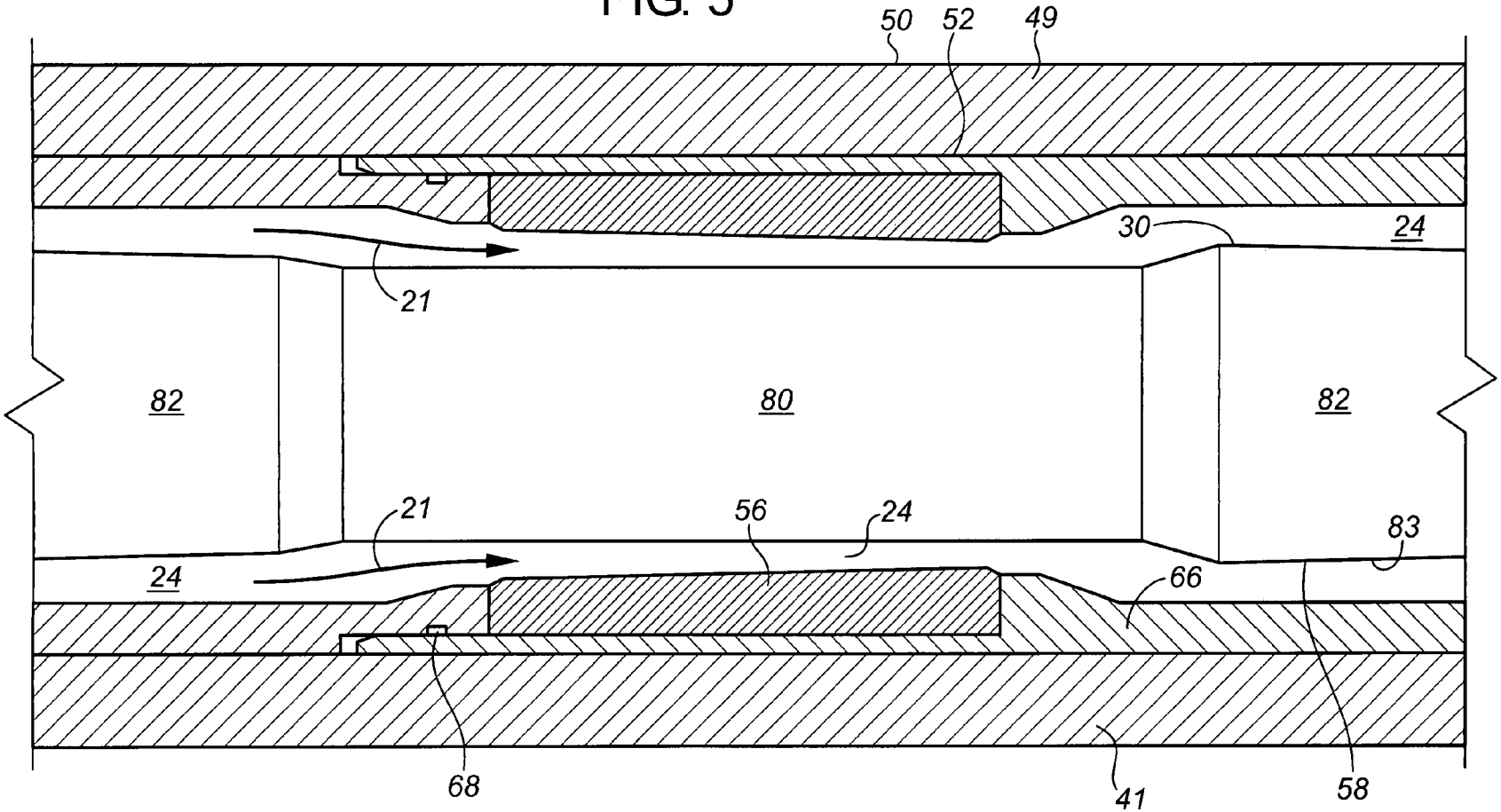
FIG. 5 is a detailed longitudinal sectional view of the portion of the alternate embodiment of the valve mechanism depicted in FIG. 4, wherein the valve mechanism is depicted as actuated to a position corresponding to the minimum pressure drop position of the apparatus.

FIGS. 4 and 5 show a closer or more detailed view of an alternate configuration of a single poppet (82) in relation to its corresponding orifice (56). Specifically, the flow path (24) is restricted in a manner providing for a "tapered restriction" wherein the adjacent surfaces of the poppet face (83) and the orifice (56), and thus the flow path (24) therebetween, are aligned at an angle to the longitudinal axis of the apparatus (20). FIG. 4 shows the alternate valve mechanisms (34) comprising the pressure drop device (30) in the maximum pressure drop position wherein the cross-sectional area of the flow path (24) is at a minimum. FIG. 5 shows the alternate valve mechanisms (34) comprising the pressure drop device (30) in the minimum pressure drop position wherein the cross-sectional area of the flow path (24) is at a maximum.

As stated above, the apparatus (20) is also comprised of the actuator (32) for actuating the pressure drop device (30). In the first preferred embodiment as shown in FIGS. 1-5, the actuator (32) is adapted to actuate each of the valve mechanisms (34) between the minimum and maximum pressure drop positions. The actuator (32) preferably is also adapted to actuate each of the valve mechanisms (34) between the minimum pressure drop position, the maximum pressure drop position and at least one intermediate pressure drop position.

The actuator (32) may be comprised of any type or configuration of actuating device or actuating mechanism which is compatible with the particular pressure drop device (30) and its manner of operation.

In the first preferred embodiment of FIGS. 1-5, the valve mechanisms (34) comprising the pressure drop device (30) are preferably actuated by longitudinal or axial movement of the actuator (32). In other words, the actuator (32) is a linear actuator which actuates the valve mechanisms (34) by moving axially or longitudinally relative to the longitudinal axis of the apparatus (20).

Thus, with respect to each of the valve mechanisms (34), longitudinal movement of the actuator (32) causes relative longitudinal movement of the orifice (56) and the flow restrictor member (58). More particularly, the actuator (32) is operatively connected with the poppet shaft (80) by the poppet shaft connector (88). Thus, axial or longitudinal movement of the actuator (32) causes a corresponding axial or longitudinal movement of the poppet shaft (80) relative to the orifice assembly (60). As a result, the poppets (82) are moved longitudinally relative to their corresponding orifices (56).

Further, although the longitudinal movement of the actuator (32) may be controlled in any manner, the longitudinal movement is preferably controlled by a pressure exerted by the fluid (21) on the actuator (32). However, alternately, the actuator (32) may be controlled by longitudinal or rotational manipulation of the drill string (23) or by any other suitable control mechanism.

The actuator (32) is preferably configured to be controlled by the pressure and/or the flow rate of the fluid (21) passing through the apparatus bore (27) in order to actuate the pressure drop device (30), and particularly the valve mechanisms (34), between the predetermined or preset pressure drop positions.

One device which could be adapted to be suitable for use as the actuator (32) in the present invention is the linear indexing apparatus disclosed in U.S. Pat. No. 5,826,661 issued Oct. 27, 1998 to Parker et. al., which is incorporated herein by reference. A further device which could be adapted to be suitable for use as the actuator (32) in the present invention is the linear indexing apparatus disclosed in U.S. Pat. No. 6,119,783 issued Sep. 19, 2000 to Parker et. al., which is also incorporated herein by reference.

A more preferred device suitable for use as the actuator (32) in the present invention is a bi-pressure subassembly which includes a barrel cam (98) activated by pressure changes in the fluid (21) introduced by cycling the pumps that pump the fluid (21). One example of equipment that could be adapted to function as a bi-pressure subassembly is the Adjustable Gauge Stabilizer (AGS™) manufactured by Halliburton Sperry-Sun.

U.S. Pat. No. 6,158,533 to Gillis et al. and U.S. Pat. No. 6,328,119 issued Dec. 11, 2001 to Gillis et. al. disclose an Adjustable Gauge Down hole Drilling Assembly (Adjustable Gauge Motor (AGM™) that includes a similar barrel cam apparatus and are also incorporated herein by reference.

As adapted for use in the present invention, the AGS™ and the AGM™ are both capable of operating to cause the actuator (32) to actuate the valve mechanisms (34) between the predetermined pressure drop positions.

Figure 6A:
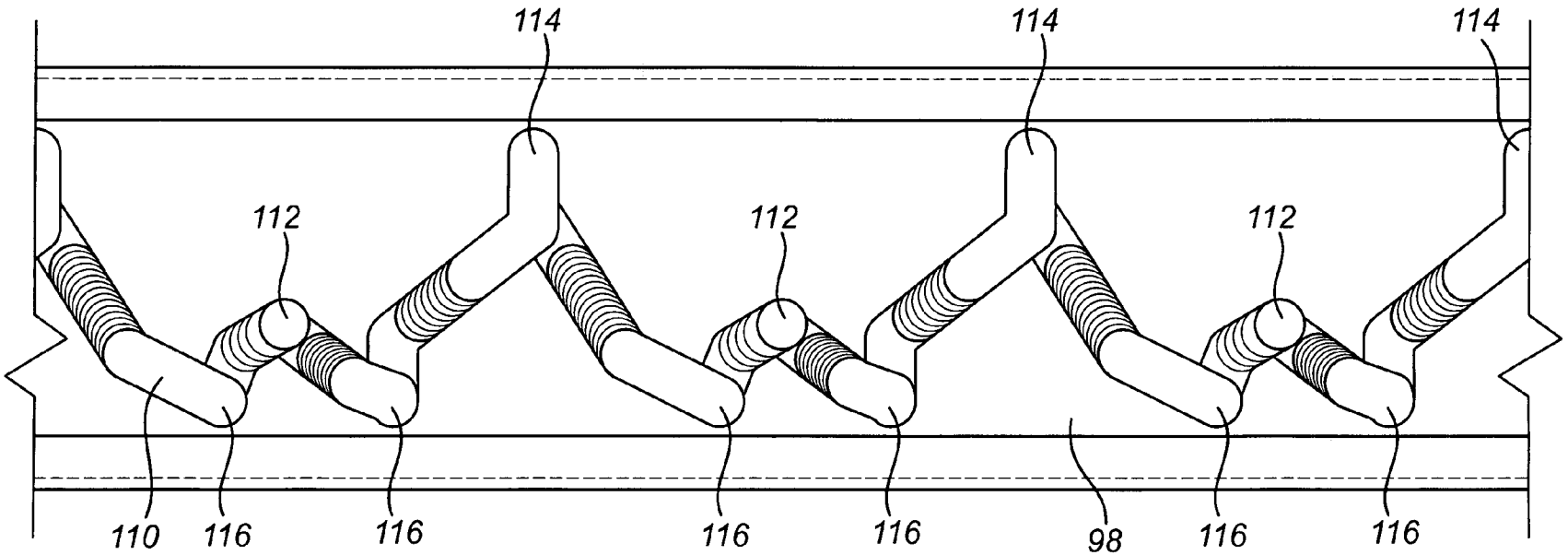
FIG. 6(*a*) is a flat view of an outer surface of a barrel cam for use in a preferred embodiment of an actuator according to the invention which is capable of actuating the apparatus between the minimum pressure drop position and the maximum pressure drop position, and FIG. 6(*b*) is a flat view of an outer surface of a modified barrel cam which is capable of actuating the apparatus between the minimum pressure drop position, the maximum pressure drop position, and an intermediate pressure drop position.
Figure 6B:
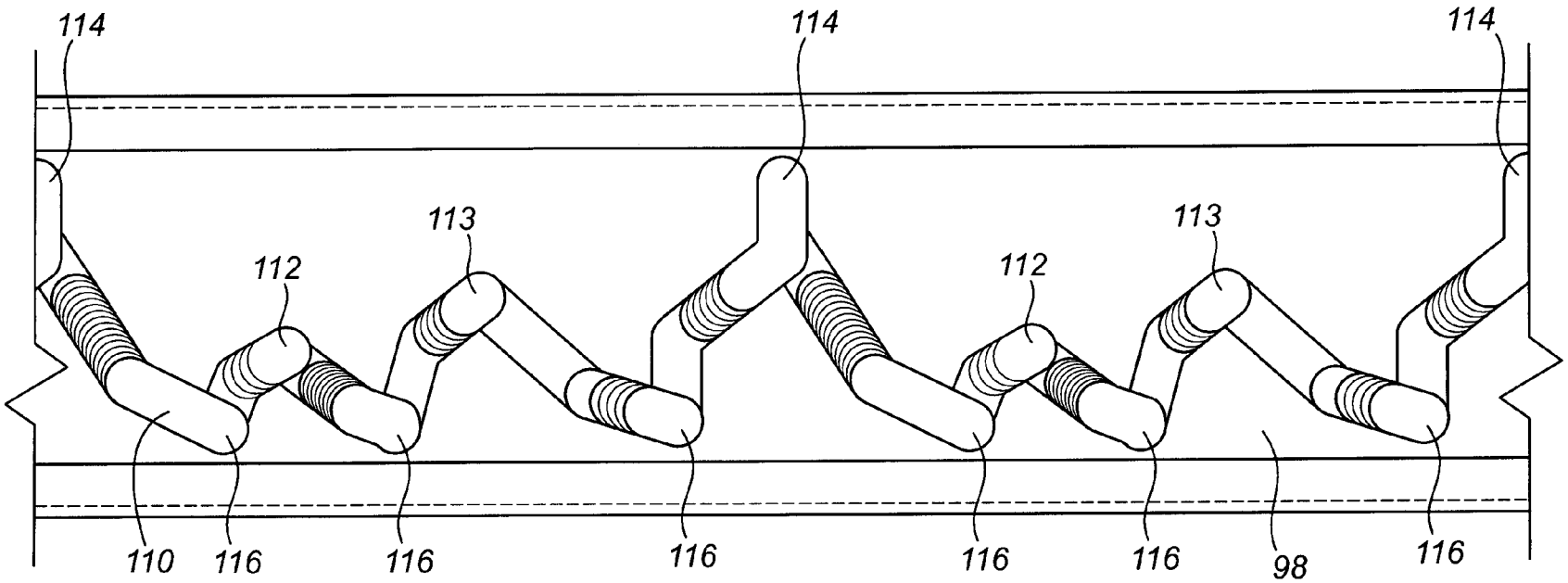

Referring to FIG. 1 of the first preferred embodiment of the apparatus (20) and to FIG. 6, the actuator sub assembly (36) is comprised of the actuator (32). The actuator (32) is comprised of a barrel cam mandrel (100) having an upper end (102) and a lower end (104) and defining a mandrel chamber (105) between an outer surface of the barrel cam mandrel (100) and an adjacent inner surface (52) of the housing (49). The lower end (104) of the barrel cam mandrel (100) is removably or fixedly connected with the poppet shaft connector (88) while the fluid (21) exerts a pressure on the upper end (102) to longitudinally move the barrel cam mandrel (100) relative to the housing (49).

The barrel cam mandrel (100) and its associated components provide an indexing mechanism to facilitate movement of the pressure drop device (30) between various pressure drop positions, as described previously. A tubular barrel cam (98) is rotatably mounted on and about the barrel cam mandrel (100) and is supported by an upper thrust bearing (106) and a lower thrust bearing (108). The barrel cam (98) is thus contained in the mandrel chamber (105) and is capable of rotation relative to the mandrel (100).

Referring to FIG. 6(*a*), the barrel cam (98) includes a continuous groove (110) around its external circumference. A first position (112) in the groove (110) corresponds to a first downward position of the mandrel (100) in which the apparatus (20) is in the minimum pressure drop position. A second position (114) in the groove (110) corresponds to a second or maximum downward position of the mandrel (100) in which the apparatus (20) is in the maximum pressure drop position. A third position (116) in the groove (110) corresponds to a maximum upward position of the barrel cam mandrel (100) in which the apparatus (20) is in a rest position.

The groove (110) varies in depth about the circumference of the barrel cam (98) such that step changes are provided in its depth to prevent the barrel cam (98) from moving in a reverse direction. As a result, the barrel cam (98) is forced to move in a known path at every pump cycle as described below.

As depicted in FIG. 6(*a*), the barrel cam (98) is capable of actuating the apparatus (20) only between the minimum pressure drop position and the maximum pressure drop position. Referring to FIG. 6(*b*), the barrel cam (98) may be modified to be capable of actuating the apparatus (20) to one or more intermediate pressure drop positions by providing one or more intermediate positions in the groove (110) which are located between the first position (112) and the second position (114). Specifically, in FIG. 6(*b*), an intermediate position (113) is provided in the groove (110), which intermediate position is located longitudinally between the first position (112) and the second position (114).

The barrel cam (98) is held on the barrel cam mandrel (100) by an upper retaining ring (118) fixedly connected to the barrel cam mandrel (100) and a lower retaining ring (120) fixedly connected with the barrel cam mandrel (100). The lower retaining ring (120) is preferably associated with a wear ring (121). Further, the first section (35) of the apparatus (20) includes a pair of barrel cam bushings (122) which are separated by 180°. These barrel cam bushings (122) protrude into the mandrel chamber (105) adjacent to the barrel cam (98). At least one of these barrel cam bushings (122) is equipped with a barrel cam pin (124) which also protrudes into the mandrel chamber (105) for engagement with the groove (110) in the barrel cam (98). The barrel cam pin (124) is spring loaded so that it is urged into the mandrel chamber (105) but is capable of limited radial movement in order to enable it to move in the groove (110) about the entire circumference of the barrel cam (98) as the barrel cam (98) rotates relative to the barrel cam mandrel (100) and the housing (49).

As indicated, the variable depth groove (110) in the barrel cam (98) preferably includes steps along its length so that the barrel cam pin (124) can move only in one direction in the groove (110) and will be prevented from moving in the other direction due to the combined effects of the spring loading of the barrel cam pin (124) and the steps in the groove (110).

Referring to FIG. 6(*a*), the groove (110) is configured so that the barrel cam pin (124) will move in sequence in the groove (110) to the first position (112), the third position (116), the second position (114), the third position (116), the first position (112), the third position (116), the second position (114), the third position (116), and so on. In other words, the pressure drop device (30) always moves into the rest position between movements to the maximum or minimum pressure drop positions.

Similarly, referring to FIG. 6(*b*), the groove (110) is configured so that the barrel cam pin (124) will move in sequence in the groove (110) to the first position (112), the third position (116), the second position (114), the third position (116), the intermediate position (113), the third position (116), the first position (112), the third position (116), and so on.

In addition, in the preferred embodiment of the actuator (32), the upper end (102) of the barrel cam mandrel (100) comprises a spring mandrel (126). Further, the spring mandrel (126) includes a spring cap (132) which particularly defines the upper end (102) of the barrel cam mandrel (100). The spring mandrel (126) and its associated components provide a biasing device for urging the barrel cam mandrel (100) toward the upper end (26) of the apparatus (20). The spring mandrel (126) defines a spring chamber (128) in an annular space between the spring mandrel (126) and the adjacent surface of the first section (35) of the apparatus (20). A return spring (130) and a spring thrust bearing (134) are contained in the spring chamber (128).

The spring cap (132) engages the adjacent inner surface (52) of the housing (49). Further, at least one wear ring (136), a seal (138) such as an O-ring and at least one non-pressure or low pressure holding wiper (139) are positioned between the engaged surfaces of the spring cap (132) and the housing (49). The relative positions of the wear ring (136), the seal (138) and the wiper (139) along the spring cap (132) may be varied from that shown in the preferred embodiment. In addition, the function of the spring thrust bearing (134) is to permit the return spring (130) to rotate in the spring chamber (128) during its extension and compression. The return spring (130) is capable of extension and compression in the spring chamber (128) through a range corresponding at least to the permitted axial movement of the cam mandrel (100).

In the preferred embodiment of the actuator (32), the upper end (102) of the barrel cam mandrel (100), comprised of the spring cap (132), communicates with the apparatus bore (27) to effect downward axial movement of the barrel cam mandrel (100) when a predetermined pressure of the fluid (21) is exerted thereon.

The lower end (104) of the barrel cam mandrel (100) defines a balancing piston chamber (140) located in an annular space between the outer surface of the lower end (104) of the barrel cam mandrel (100) and the adjacent inner surface of the first section (35) of the housing (49). The balancing piston chamber (140) contains an annular balancing piston (142) which is axially movable in the balancing piston chamber (140). The balancing piston (142) includes seals (144) on its inner radius and its outer radius which engage the outer surface of the barrel cam mandrel (100) and the inner surface of the housing (49) respectively and which prevent fluid from passing by the balancing piston (142) in the balancing piston chamber (140). Further, the balancing piston (142) preferably includes wear rings (143) on its inner radius and its outer radius.

In the preferred embodiment of the actuator (32), a borehole fluid compartment (146) is defined by that portion of the balancing piston chamber (140) which is located to one side of the balancing piston (142), preferably to the side of the balancing piston (142) nearer the lower end (40) of the actuator sub assembly (36). One end of an oil compartment (148) is defined by that portion of the balancing piston chamber (140) which is located to the other side of the balancing piston (142), preferably to the side of the balancing piston (142) nearer the upper end (38) of the actuator sub assembly (36).

The function of the borehole fluid compartment (146) is to expose the balancing piston (142) to the down hole pressure of the borehole (29) adjacent to the apparatus (20). A borehole fluid port and a filter plug or perforated filter disk (150) are located on the housing (49) adjacent to the borehole fluid compartment (146) and communicate with the borehole fluid compartment (146) for this purpose.

Since the borehole fluid compartment (146) should be exposed to the down hole pressure of the borehole (29) and not the pressure through the interior of the apparatus (20), a sealing assembly (152) is provided near the lower end (104)

of the barrel cam mandrel (100). The sealing assembly (152) is comprised of a circumferential end ring (154) including a wear ring (156) within in its inner surface and a seal (158), such as an O-ring, about both its inner surface and its outer surface. Further, the end ring (154) is preferably maintained in a desired position by at least one retaining bolt (160) or other suitable fastener.

The oil compartment (148) extends axially up hole of the balancing piston (142) to the barrel cam (98) and serves to lubricate the various components associated with the barrel cam (98). A sealable oil compartment filling port (162) is provided in the housing (49) to allow filling of the oil compartment (148).

Finally, borehole fluids may also be permitted to enter the spring chamber (128) to expose the return spring (130) to the down hole pressure of the borehole (29) adjacent to the apparatus (20). A borehole fluid port and a filter plug or perforated filter disk (164) are located on the housing (49) adjacent to the spring chamber (128) and communicate with the spring chamber (128) for this purpose. However, to contain the borehole (29) fluids therein, the upper end of the spring chamber (128) defined by the spring cap (132) is sealed as described previously. Further, a lower end of the spring chamber (128) defined by a shoulder (166) of the housing (49) and an adjacent spacer (168) are sealingly engaged with the adjacent barrel cam mandrel (100). Specifically, the shoulder (166) is comprised of at least one wear ring (170), one seal (172) such as an O-ring and at least one non-pressure or low pressure holding wiper (173). The relative positions of the wear ring (170), the seal (172) and the wiper (173) along the shoulder (166) may be varied from that shown in the preferred embodiment.

In operation of the preferred embodiment of the actuator (32), the barrel cam (98) translates along the continuous groove (110) shown in FIG. 6(*a*). When the drilling rig fluid pumps at the surface are turned on, the barrel cam (98) is forced down hole, downward or towards the lower end (40) of the actuator sub assembly (36) and twists to the next position as a result of the spring loaded barrel cam pin (124) connected with the housing (49). The twisting and downward axial movement of the barrel cam (98) is stopped when the downward portion of the groove (110) in the barrel cam (98) ends or runs out. The barrel cam (98) is then held in that position by the fluid flow and the differential pressure drop between the apparatus bore (27) through the actuator (32) and the annulus between the apparatus (20) and the borehole (29).

When the fluid flow is turned off, the return spring (130) pushes the barrel cam (98) back up hole, upwards or towards the upper end (38) of the actuator sub assembly (36). This upward motion causes the barrel cam (98) to twist the to next position. The barrel cam (98) is prevented from moving backwards due to the step changes in the depth of the groove (110) on the barrel cam (98) such that the spring loaded barrel cam pin (124) rides up (in a radial direction outward) on these ramps then falls down into the next section on the barrel cam (98). This feature forces the barrel cam (98) to move in a known path at every pump cycle.

In the preferred embodiment, as the barrel cam mandrel (100) moves up and down, the barrel cam (98) has at least 2 positions in which the barrel cam mandrel (100) is allowed to move down. The first position (112) described above may be referred to as the minimum pressure drop position or the "OFF" position. When the fluid (21) is not being circulated to perform the drilling operation, the barrel cam (98) is in the third position (116) or rest position. When the mud pumps turn on to circulate the fluid (21) down hole, the barrel cam (98) moves axially down hole for only a small amount or distance so as not to allow the poppets (82) to be coincident with the orifices (56) as shown in FIGS. 3 and 5. In the "OFF" position, the fluid (21) can flow with relative ease resulting in very little or a minimum pressure drop.

If one desires to move to the second position (114) described above, which may be referred to as the maximum pressure drop position or "ON" position, the mud pumps are first turned off and then back on. This allows the barrel cam (98) to advance to the rest position (116) and subsequently to the second position (114) such that the barrel cam mandrel (100) and attached poppet shaft (80) move further axially downward or down hole such that the poppets (82) and the orifices (56) are substantially coincident with each other as shown in FIGS. 2 and 4. This causes a relative large restriction in the flow path (24) for the fluid (21) which produces a pressure drop which will create heat from fluid shear. Alternatively, rather than turning the mud pumps completely or fully off to advance the barrel cam (98) to the rest position (116), the mud pump flow rate may be simply reduced sufficiently to permit the action of the return spring (130) to advance the barrel cam (98) to the rest position (116).

In FIG. 6(*a*) the barrel cam (98) is shown with 2 active positions in addition to the rest position. However, 3 or more active positions may be provided for such that the position of the poppets (82) relative to the orifices (56) is only partially coincident, as depicted in FIG. 6(*b*). The number of active positions is limited by the number of positions which can be accommodated by the barrel cam (98). Generally, 2 or 3 active positions are practical when utilizing the barrel cam (98) in the actuator (32) design.

FIG. 9 depicts a first variant of a second preferred embodiment of the apparatus (20) which is actuatable between the minimum pressure drop position, the maximum pressure drop position and one intermediate pressure drop position. As shown in FIG. 9 the apparatus (20) is divided longitudinally into two sides in order to depict schematically two different actuation positions of the apparatus (20) in a single drawing view.

A first side (300) of FIG. 9 depicts the apparatus (20) as actuated to the maximum pressure drop position. A second side (302) of FIG. 9 depicts the apparatus (20) as actuated to the intermediate pressure drop position.

In the second preferred embodiment, the pressure drop device (30) is comprised of a non-actuatable pressure drop device and the apparatus (20) is actuated between the pressure drop positions by altering the flow of the fluid (21) through the flow path (24).

As in the first preferred embodiment, the first section (35) of the apparatus (20) defines the actuator sub assembly (36) and the apparatus bore (27) and components of the actuator (32) are included in the actuator sub assembly (36). The second section (41) of the apparatus (20) defines the pressure drop sub assembly (42) and includes the flow path (24) and the pressure drop device (30). The first section (35) and the second section (36) are preferably connected together with a threaded connection and are preferably connected together such that the pressure drop sub assembly (42) is located down hole of the actuator sub assembly (36).

Interposed between the actuator sub assembly (36) and the pressure drop sub assembly (42) is a flow control sub assembly (304). The flow control sub assembly (304) is positioned primarily within the first section (35). The flow control sub assembly (304) includes a flow control device (306). The actuator (32) actuates the flow control device (306) in order to control the flow of the fluid (21) through the flow path (24) and thus actuate the apparatus (20) between the minimum pressure drop position, the maximum pressure drop position and the intermediate pressure drop position.

The first section (35) includes a first section housing (308). The first section housing (308) includes an upper end (310) and a lower end (312). The second section (36) includes a second section housing (314). The second section housing (314) includes an upper end (316) and a lower end (318). The upper end (310) of the first section housing (308) is connected to a top sub (320) which facilitates connection of the apparatus (20) within the drill string (23). The lower end (318) of the second section housing (314) is connected to a lower sub (322) which also facilitates connection of the apparatus (20) within the drill string (23). The lower end (312) of the first section housing (308) is threadably connected with the upper end (316) of the second section housing (314). In the preferred embodiment, this threaded connection provides a metal-to-metal seal which seals the pressure of the fluid (21) in the flow path (24) from the surrounding annulus pressure.

The pressure drop sub assembly (42) includes the pressure drop device (30). In the second preferred embodiment the pressure drop device (30) is comprised of an orifice assembly (324) which defines a tortuous path through the flow path (24). Preferably, the orifice assembly (324) is comprised of longitudinally alternating inner orifice flanges (326) and outer orifice flanges (328), each of which is comprised of a separate orifice member (330) so that the orifice assembly (324) is comprised of a plurality of longitudinally spaced orifice members (330). However, the tortuous path may be defined by any other suitable configurations of the orifice assembly (324). For instance, rather than the stacked orifice flanges (326, 328), the orifice assembly (324) may provide a plurality of stacked plates or members defining a spiral tortuous path or including internal upsets in any form capable of defining the desired tortuous path, such as spokes, ridges or spiraled ridges.

The orifice assembly (324) is positioned within the flow path (24). More particularly, the orifice assembly (324) is contained within an orifice assembly chamber (332) which is positioned within the flow path (24). The number of orifice members (330) is selected to provide the desired pressure drop or energy loss as the fluid (21) flows through the orifice assembly (324).

Referring to the first side (300) of FIG. 9, the orifice assembly chamber (332) accommodates a maximum number of ten inner orifice flanges (326) and eleven outer orifice flanges (328) in order to provide a maximum pressure drop through the flow path (24). However, the orifice assembly chamber (332) may be adapted or configured to accommodate any desired number of inner and outer orifice flanges (326, 328). The flanges (326,328) are urged against an upper orifice assembly chamber end (334) by bellville springs (336) which are also located within the orifice assembly chamber (332) adjacent to a lower orifice assembly chamber end (338).

Referring to the second side of FIG. 9, the orifice assembly (302) is depicted as including five inner orifice flanges (326) and five outer orifice flanges (328), and the remainder of the orifice assembly chamber (332) is filled with inner spacers (340), outer spacers (342) and a flow deflector (344). The flow deflector (344) deflects fluid (21) away from the bellville springs (336) in order to protect the bellville springs (336) from the erosive effects of the fluid (21).

The orifice assembly chamber (332) is defined radially by the second section housing (314) and by a flow path bypass tube (346). The upper orifice assembly chamber end (334) is defined by a shoulder (348) on the second section housing (314) and by a lower end (350) on a flow splitter (352). The lower orifice assembly chamber end (338) is defined by a lower centralizer (354).

The lower end (350) of the flow splitter (352) is threadably connected to an upper end (356) of the flow path bypass tube (346). A lower end (358) of the flow path bypass tube (346) is threadably connected to an upper end (360) of the lower centralizer (354). The interiors of the flow splitter (352), the flow path bypass tube (346) and the lower centralizer (354) together define a flow path bypass (362). The apparatus bore (27) through the second section (41) of the apparatus (20) is therefore comprised of the flow path (24) and the flow path bypass (362) as alternate pathways.

The lower centralizer (354) is longitudinally supported in the apparatus (20) by a lower sub shoulder (364) so that the flow splitter (352), the flow path bypass tube (346) and the lower centralizer (354) do not move longitudinally relative to the first section housing (308) and the second section housing (314).

The flow control sub assembly (304) includes the flow control device (306). The function of the flow control device (306) is to alter the flow rate of the fluid (21) through the flow path (24) in order to actuate the apparatus (20). As depicted in FIG. 9, the flow control device (306) alters the flow rate of the fluid (21) through the flow path (24) by selectively directing a portion of the fluid (21) through the flow path bypass (362) instead of through the flow path (24).

The flow control device (306) is comprised of a flow control valve mechanism (366). As depicted in FIG. 9 the flow control valve mechanism (366) is actuatable by the actuator (32) between a first position corresponding to the minimum pressure drop position, a second position corresponding to the maximum pressure drop position and an intermediate position corresponding to the intermediate pressure drop position.

The first side (300) of FIG. 9 depicts the flow control valve mechanism (366) as actuated to the second position. The second side (302) of FIG. 9 depicts the flow control valve mechanism (366) as actuated to the intermediate position.

The flow control valve mechanism (366) is comprised of the flow splitter (352). The flow splitter (352) includes a bypass port (368) which is comprised of at least one lateral channel, and preferably four lateral channels, formed in the side wall of the flow splitter (352). The flow splitter (352) also includes a nozzle port (370) which is comprised of a channel formed in an upper end wall (372) of the flow splitter (352).

The flow control valve mechanism (366) is further comprised of a bypass port sealing sleeve (374) which is telescopically mounted on the exterior of the flow splitter (352) and which is longitudinally movable relative to the flow splitter (352).

The bypass port sealing sleeve (374) includes a bypass port sealing member (376) which is comprised of a depending side wall of the bypass port sealing sleeve (374). As depicted in FIG. 9, the bypass port sealing sleeve (374), including the bypass port sealing member (376), is comprised of two separate pieces or components which are connected together. Alternatively, the bypass port sealing sleeve (374) may be comprised of a single piece or component or more than two pieces or components.

The bypass port sealing sleeve (374) is longitudinally movable relative to the flow splitter (352) between a position in which the bypass port (368) is unobstructed by the bypass port sealing member (376) and a position in which the bypass port (368) is sealed by the bypass port sealing member (376). When the bypass port sealing sleeve (374) is in the bypass port (368) sealing position, the bypass port sealing sleeve (374) abuts a flow splitter shoulder (377) on the flow splitter (352), thus preventing further longitudinal movement of the bypass port sealing sleeve (374) relative to the flow splitter (352).

If desired or required, the sealing of the bypass port (368) by the bypass port sealing member (376) may be facilitated or enhanced by the presence of a seal or other sealing structure or mechanism. For instance, the surface of the bypass port sealing member (376) which is intended to seal with the flow splitter (352) about the bypass port (368) may include an elastomer coating, a coating of an alternate sealing material or a seal such as an O-ring. Alternately or in addition, the surface of the flow splitter (352) about the bypass port (368) which is intended to seal with the bypass port sealing member (376) may include an elastomer coating, a coating of an alternate sealing material or a seal such as an O-ring.

The bypass port sealing sleeve (374) is further comprised of a bypass nozzle (378) which communicates with the nozzle port (370) in the flow splitter (352). The bypass nozzle (378) is located at an upper end (380) of the bypass port sealing member (376).

The flow control valve mechanism (366) is further comprised of a bypass nozzle sealing sleeve (382) which is telescopically and concentrically mounted within the bypass port sealing sleeve (374) and which is longitudinally movable relative to the bypass port sealing sleeve (374). The bypass nozzle sealing sleeve (382) is also telescopically and concentrically mounted on the exterior of a flow mandrel (383) so that the bypass port sealing sleeve (374) and the bypass nozzle sealing sleeve (382) are both contained radially between the flow mandrel (383) and the first section housing (308).

As depicted in FIG. 9 the flow mandrel (383) abuts the top sub (320) and is thus restrained against upward movement relative to the first section housing (308). If necessary or desired to restrain any such upward movement, one or more bellville springs or compressible spacers, such as Teflon™ spacers, may be positioned between the flow mandrel (383) and the top sub (320). The flow mandrel (383) is restrained against downward relative movement relative to the first section housing (308) by a split ring (385) and a split ring retainer (387).

The bypass nozzle sealing sleeve (382) includes a bypass nozzle sealing member (384) which is aligned with the bypass nozzle (378). As depicted in FIG. 9, the bypass nozzle sealing sleeve (382), including the bypass nozzle sealing member (384), is comprised of two separate pieces or components which are connected together. Alternatively, the bypass port sealing sleeve (382) may be comprised of a single piece or component or more than two pieces or components.

The bypass nozzle sealing sleeve (382) is longitudinally movable relative to the bypass nozzle (378) between a position in which the bypass nozzle (378) is unobstructed by the bypass nozzle sealing member (384) and a position in which the bypass nozzle (378) is sealed by the bypass nozzle sealing member (384). When the bypass nozzle sealing sleeve (382) is in the bypass nozzle (378) sealing position, the bypass nozzle sealing member (384) abuts the bypass nozzle (378), thus preventing further longitudinal movement of the bypass nozzle sealing sleeve (382) relative to the bypass nozzle (378).

If desired or required, the sealing of the bypass nozzle (378) by the bypass nozzle sealing member (384) may be facilitated or enhanced by the presence of a seal or other sealing structure or mechanism. For instance, the surface of the bypass nozzle sealing member (384) which is intended to seal with the upper end (380) of the bypass port sealing member (376), and thereby seal the bypass nozzle (378), may include an elastomer coating, a coating of an alternate sealing material or a seal such as an O-ring. Alternately or in addition, the surface of the upper end (380) of the bypass port sealing member (376) which is intended to seal with the bypass nozzle sealing member (384), and thereby seal the bypass nozzle (378), may include an elastomer coating, a coating of an alternate sealing material or a seal such as an O-ring.

The bypass port (368) and the bypass port sealing member (376) provide a first flow control valve mechanism (386). The bypass nozzle (378) and the bypass nozzle sealing member (384) provide a second flow control valve mechanism (388). In addition, the bypass port sealing sleeve (374) and the bypass nozzle sealing sleeve (382) provide a centralizing function to the flow splitter (352) and an upper centralizing function to the assembly comprising the flow splitter (352), the flow path bypass tube (346) and the lower centralizer (354). This centralizing function is assisted by the radial containment of the sleeves (374,382) between the flow mandrel (383) and the first section housing (308).

The flow control valve mechanism (366) is actuatable between a first position in which neither the bypass port (368) nor the bypass nozzle (378) is sealed, a second position in which both the bypass port (368) and the bypass nozzle (378) are sealed, and potentially two intermediate positions in which only one of the bypass port (368) and the bypass nozzle (378) is sealed. The first position of the flow control valve mechanism (366) corresponds to the minimum pressure drop position of the apparatus (20), the second position of the flow control valve mechanism (366) corresponds to the maximum pressure drop position of the apparatus (20), and the intermediate positions of the flow control valve mechanism (366) correspond to intermediate pressure drop positions of the apparatus (20).

When the flow control valve mechanism (366) is in the first position, a minimum flow path flow rate of the fluid (21) through the flow path (24) and a maximum bypass flow rate of the fluid (21) through the flow path bypass (362) are provided, with the result that a relatively low proportion of the fluid (21) is passed through the pressure drop device (30).

When the flow control valve mechanism (366) is in the second position, a maximum flow path flow rate of the fluid (21) through the flow path (24) and a minimum bypass flow rate of the fluid (21) through the flow path bypass (362) are provided, with the result that a relatively high proportion of the fluid (21) is passed through the pressure drop device (30).

When the flow control valve mechanism (366) is in one of the intermediate positions, an intermediate flow path flow rate of the fluid (21) through the flow path (24) and an intermediate bypass flow rate of the fluid (21) through the flow path bypass (362) are provided, with the result that an intermediate proportion of the fluid (21) is passed through the pressure drop device (30).

The flow path flow rate, the bypass flow rate and the relative magnitudes of the flow path flow rate and the bypass flow rate can be controlled by controlling the overall flow rate of the fluid (21) through the apparatus (20) or by sizing and configuring the pressure drop device (30), the first flow control valve mechanism (386) and the second flow control valve mechanism (388). For example, the number of orifice members (330) in the orifice assembly (324) can be varied, as can the sizes of the bypass port (368) and the bypass nozzle (378).

In addition, if desired, a secondary pressure restriction or pressure drop device (not shown) may be utilized for further controlling the overall flow rate of the fluid (21) through the apparatus (20). For instance, referring to FIG. 9(*c*), a secondary pressure restriction or pressure drop device may be positioned within the flow path bypass (362) to further control the bypass flow rate. In this case, the secondary pressure restriction or pressure drop may be comprised of a nozzle or choke mechanism positioned within the flow path bypass (362), preferably within the orifice assembly (324). The nozzle or choke may facilitate adjustment, control or fine tuning of the bypass flow rate.

In the first variant of the second preferred embodiment the flow control device (306) is actuatable by applying a longitudinal movement to the flow control valve mechanism (366). In this embodiment the flow control device (306) is actuatable by sequentially actuating the first flow control valve mechanism (386) and the second flow control valve mechanism (388) in order to provide the minimum pressure drop position, one intermediate pressure drop position, and the maximum pressure drop position.

In the first variant of the second preferred embodiment the first position of the flow control valve mechanism (366) is a first longitudinal position of the flow control valve mechanism (366), the second position of the flow control valve mechanism (366) is a second longitudinal position of the flow control valve mechanism (366), and the intermediate position of the flow control valve mechanism (366) is an intermediate longitudinal position of the flow control valve mechanism (366). In this embodiment neither the bypass port (368) nor the bypass nozzle (378) is sealed when the flow control valve mechanism (366) is in the first longitudinal position, both the bypass port (368) and the bypass nozzle (378) are sealed when the flow control valve mechanism (366) is in the second longitudinal position, and only the bypass port (368) is sealed when the flow control valve mechanism (366) is in the intermediate longitudinal position.

The bypass port sealing sleeve (374) and the bypass nozzle sealing sleeve (382) are both preferably biased upwards toward the upper end (26) of the apparatus (20) using biasing mechanisms such as springs. Preferably the bypass port sealing sleeve (374) is biased upwards relative to the first section housing (308) by a first biasing mechanism (390) and preferably the bypass nozzle sealing sleeve (382) is biased upwards relative to the bypass port sealing sleeve (374) by a second biasing mechanism (392). The second biasing mechanism (392) provides a greater biasing force than the first biasing mechanism (390) so that the bypass port sealing sleeve (374) will move downwards, toward the lower end (28) of the apparatus (20), relative to the first section housing (308) in response to a pressure or force applied to the bypass nozzle sealing sleeve (382) before the bypass nozzle sealing sleeve (382) moves downward relative to the bypass port sealing sleeve (374). This ensures that the intermediate longitudinal position of the flow control valve mechanism (366) will result in the bypass port (368) being sealed while the bypass nozzle (378) remains unobstructed.

The flow control valve mechanism (366) may be actuated from the first longitudinal position to the intermediate longitudinal position by applying a downward force to the bypass nozzle sealing sleeve (382) in order to move the bypass port sealing sleeve (374) downward in order to seal the bypass port (368). The flow control valve mechanism (366) may be actuated from the intermediate longitudinal position to the second longitudinal position by applying a further downward force to the bypass nozzle sealing sleeve (382) in order to move the bypass nozzle sealing sleeve (382) downward in order to seal the bypass nozzle (378).

The bypass port sealing sleeve (374) and the bypass nozzle sealing sleeve (382) are concentrically contained within the apparatus bore (27) in the first section housing (308) so that they are longitudinally movable relative to the first section housing (308). The bypass nozzle sealing sleeve (382) is provided with channels (394) extending therethrough to permit the fluid (21) to pass through the bypass nozzle sealing sleeve (382). Similarly, the bypass port sealing sleeve (374) is provided with channels (396) to permit the fluid (21) to pass through the bypass port sealing sleeve (382) and into the flow path (24).

The first variant of the second preferred embodiment of the apparatus (20) may be comprised of any actuator (32) which is suitable to actuate the flow control valve mechanism (366) as described above. For example, the second preferred embodiment of the apparatus (20) may be comprised of an actuator (32) similar to the actuator (32) described above with respect to the first preferred embodiment. In order to facilitate actuation of the flow control valve mechanism (366) to three active positions, the barrel cam (98) of FIG. 6(*a*) may be modified to provide the barrel cam (98) of FIG. 6(*b*). Referring to FIG. 6(*b*), the first position (112) in the groove (110) will correspond to the first longitudinal position of the flow control valve mechanism (366), the second position (114) in the groove (110) will correspond to the second longitudinal position of the flow control valve mechanism (366), and the intermediate position (113) in the groove (110) will correspond to the intermediate longitudinal position of the flow control valve mechanism (366).

Referring to FIG. 1, the barrel cam mandrel (100) may then be removably or fixedly connected with the bypass nozzle sealing sleeve (382) as depicted in FIG. 9 in order to apply longitudinal movement to the flow control valve mechanism (366) when the fluid (21) is passed through the apparatus bore (27) and exerts a pressure on the upper end (102) of the barrel cam mandrel (100).

Alternatively, and as depicted in FIG. 9, the actuator (32) is comprised of two separate devices.

First, the actuator (32) is comprised of an actuating device (not shown) for manually applying longitudinal and rotational movement to the bypass nozzle sealing sleeve (382). The actuating device may be comprised of a tool which is extendable within the drill string (23) and the apparatus (20) using a tubing string or a wireline. The actuating device is adapted to engage the bypass nozzle sealing sleeve (382) in order to apply the required movements to the bypass nozzle sealing sleeve (382). Where the actuating device is deployed by a wireline, it may include structure and apparatus for applying the required movements, since the wireline may not permit manipulation of the actuating device from outside of the drill string (23).

Second, the actuator (32) is comprised of a locking mechanism (398) for locking the flow control valve mechanism (366) in a desired longitudinal position. As depicted in FIG. 9 the locking mechanism (398) is comprised of a J-slot mechanism. The J-slot mechanism is comprised of a J-sleeve (400) which is concentrically mounted within the first section housing (308).

The J-sleeve (400) is fixed to the first section housing (308) with the split ring (385) and the split ring retainer (387) so that an upper end (402) of the J-sleeve (400) is radially positioned between the flow mandrel (383) and the first section housing (308) and a lower end (404) of the J-sleeve (400) is radially positioned between the bypass port sealing sleeve (374) and the first section housing (308). Radial clearance is provided between the upper end (402) of the J-sleeve (400) and the flow mandrel (383) in order to facilitate longitudinal movement of the bypass port sealing sleeve (374) and the bypass nozzle sealing sleeve (382).

The J-sleeve (400) includes at least one, but preferably a plurality of longitudinal J-slot grooves (406) which extend along the J-sleeve (400). Each J-sleeve groove (406) includes a first transverse slot (408) corresponding to the first longitudinal position of the flow control valve mechanism (366), a second transverse slot (410) corresponding to the second longitudinal position of the flow control valve mechanism (366), and an intermediate transverse slot (412) corresponding to the intermediate longitudinal position of the flow control valve mechanism (366).

The transverse slots (408,410,412) each terminate with a short longitudinal end section (not shown) to facilitate "locking" of the flow control valve mechanism (366) at a desired longitudinal position. Care should be taken to limit the length of the end sections relative to the configuration of the flow control valve mechanism (366) in order to ensure that the locking of the flow control valve mechanism (366) does not cause an "unsealing" of the bypass port (368) and/or the bypass nozzle (378).

The bypass nozzle sealing sleeve (382) is provided with a number of control pins (414) which corresponds to the number of J-sleeve grooves (406). Each control pin (414) extends radially outward from the bypass nozzle sealing sleeve (382) to engage with a J-sleeve groove (406). The bypass port sealing sleeve (374) is provided with control pin apertures (416) corresponding to the control pins (414). The control pin apertures (416) enable the control pins (414) to extend through the bypass port sealing sleeve (374) to engage with the J-sleeve grooves (406), enable relative longitudinal movement between the bypass port sealing sleeve (374) and the bypass nozzle sealing sleeve (382), and contain the springs from the second biasing mechanism (392).

In order to actuate this embodiment of the apparatus (20), the actuating device may be inserted in the drill string (23), through the top sub (320), and through the flow mandrel (383) in order to engage the bypass nozzle sealing sleeve (382).

In order to actuate the apparatus (20) from the minimum pressure drop position to the intermediate pressure drop position, the actuating device may first exert a downward and rotational force on the bypass nozzle sealing sleeve (382) in order to move the control pins (414) out of the first transverse slots (408). The actuating device may then exert a longitudinal force on the bypass nozzle sealing sleeve (382) in order to move the flow control valve mechanism (366) from the first longitudinal position to the intermediate longitudinal position. The bypass nozzle sealing sleeve (382) and the bypass port sealing sleeve (374) will move together longitudinally against the first biasing mechanism (390). Once the intermediate longitudinal position has been reached, the actuating device may exert a rotational force on the bypass nozzle sealing sleeve (382) in order to move the control pins (414) into the intermediate transverse slots (412). The actuating device may then be removed and the control pins (414) will be urged into the longitudinal end sections of the intermediate transverse slots (412) by the biasing mechanisms (390,392).

In order to actuate the apparatus (20) from the intermediate pressure drop position to the maximum pressure drop position, the actuating device may first exert a downward and rotational force on the bypass nozzle sealing sleeve (382) in order to move the control pins (414) out of the intermediate transverse slots (412). The actuating device may then exert a longitudinal force on the bypass nozzle sealing sleeve (382) in order to move the flow control valve mechanism (366) from the intermediate longitudinal position to the second longitudinal position. The bypass nozzle sealing sleeve (382) will move relative to the bypass port sealing sleeve (374) against the second biasing mechanism (392) once the bypass port sealing sleeve (374) is abutting the flow splitter shoulder (377). Once the second longitudinal position has been reached, the actuating device may exert a rotational force on the bypass nozzle sealing sleeve (382) in order to move the control pins (414) into the second transverse slots (410). The actuating device may then be removed and the control pins (414) will be urged into the longitudinal end sections of the second transverse slots (410) by the biasing mechanisms (390,392).

Figure 10:
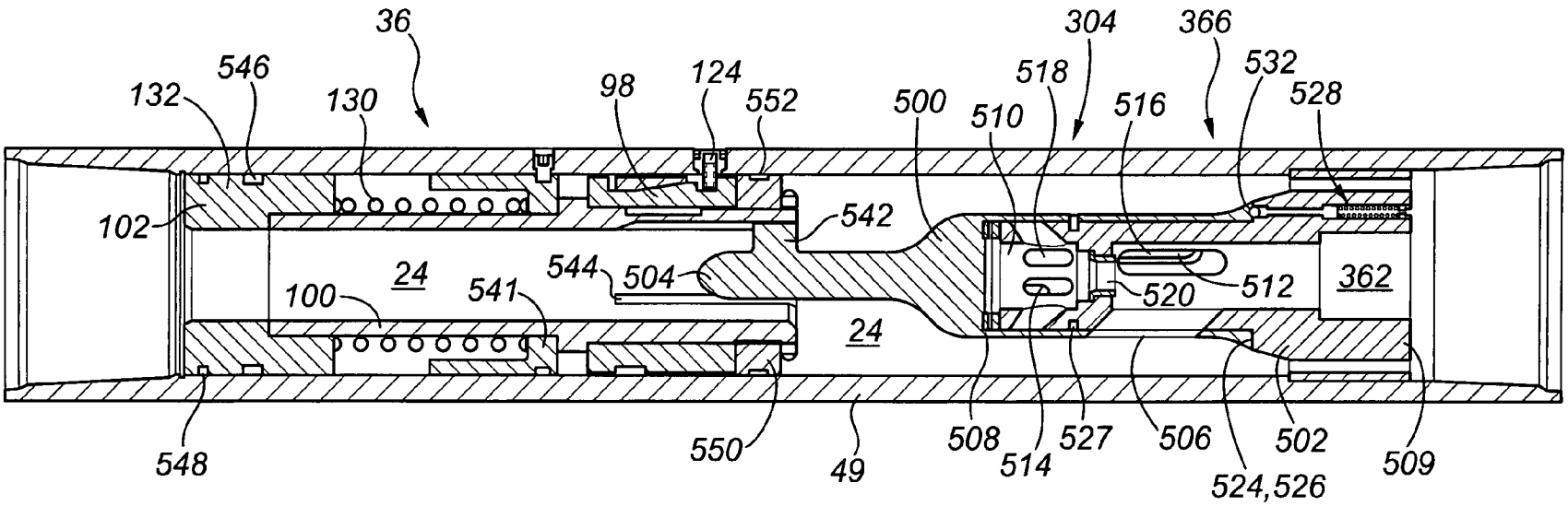
FIG. 10 is a partial longitudinal section view of a second variant of an alternate embodiment of an apparatus according to the invention which includes a flow control device, depicting the flow control device and the actuator.
Figure 11:
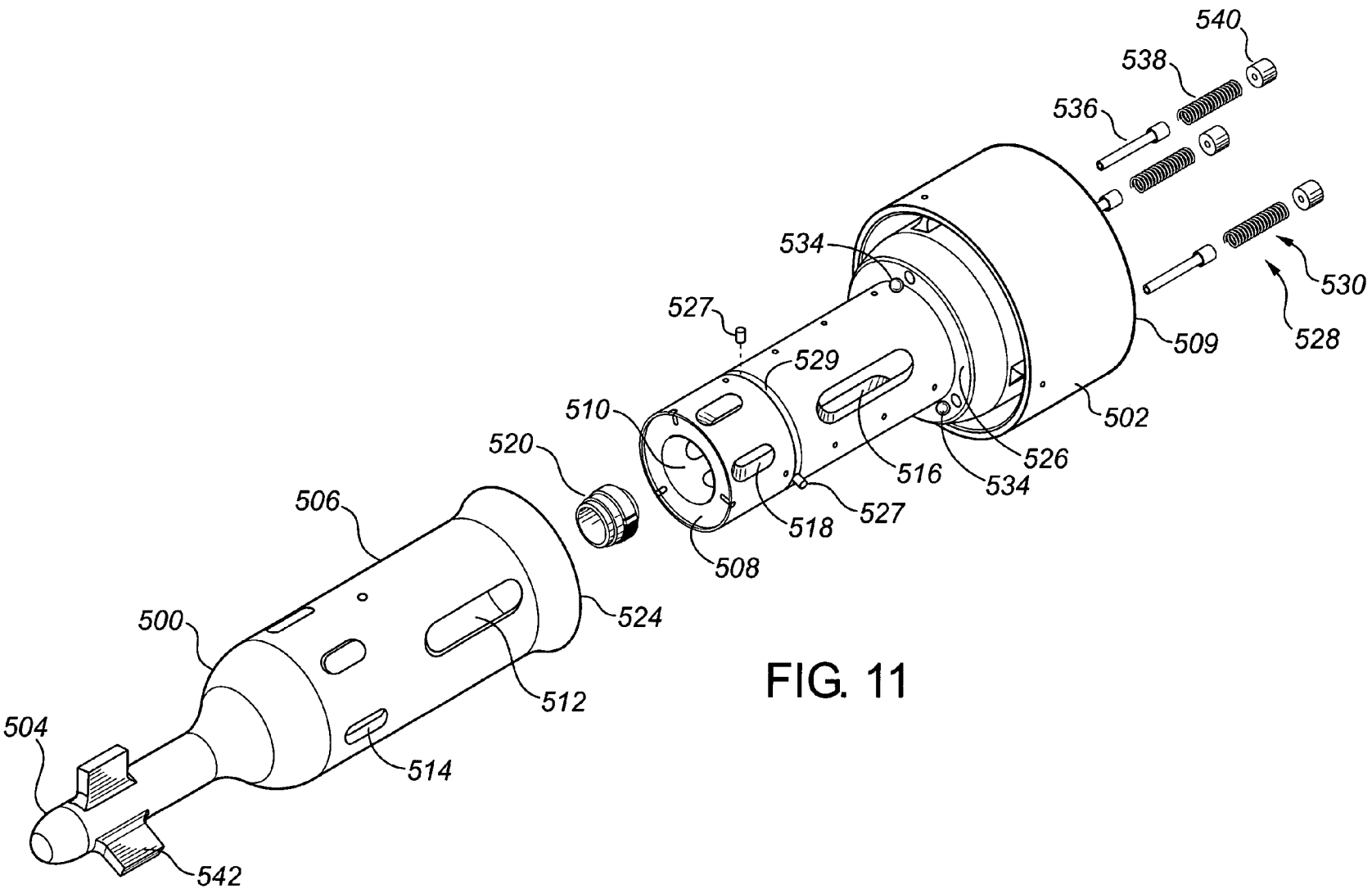
FIG. 11 is an exploded view of the flow control device for the apparatus depicted in FIG. 10.
Figure 12:
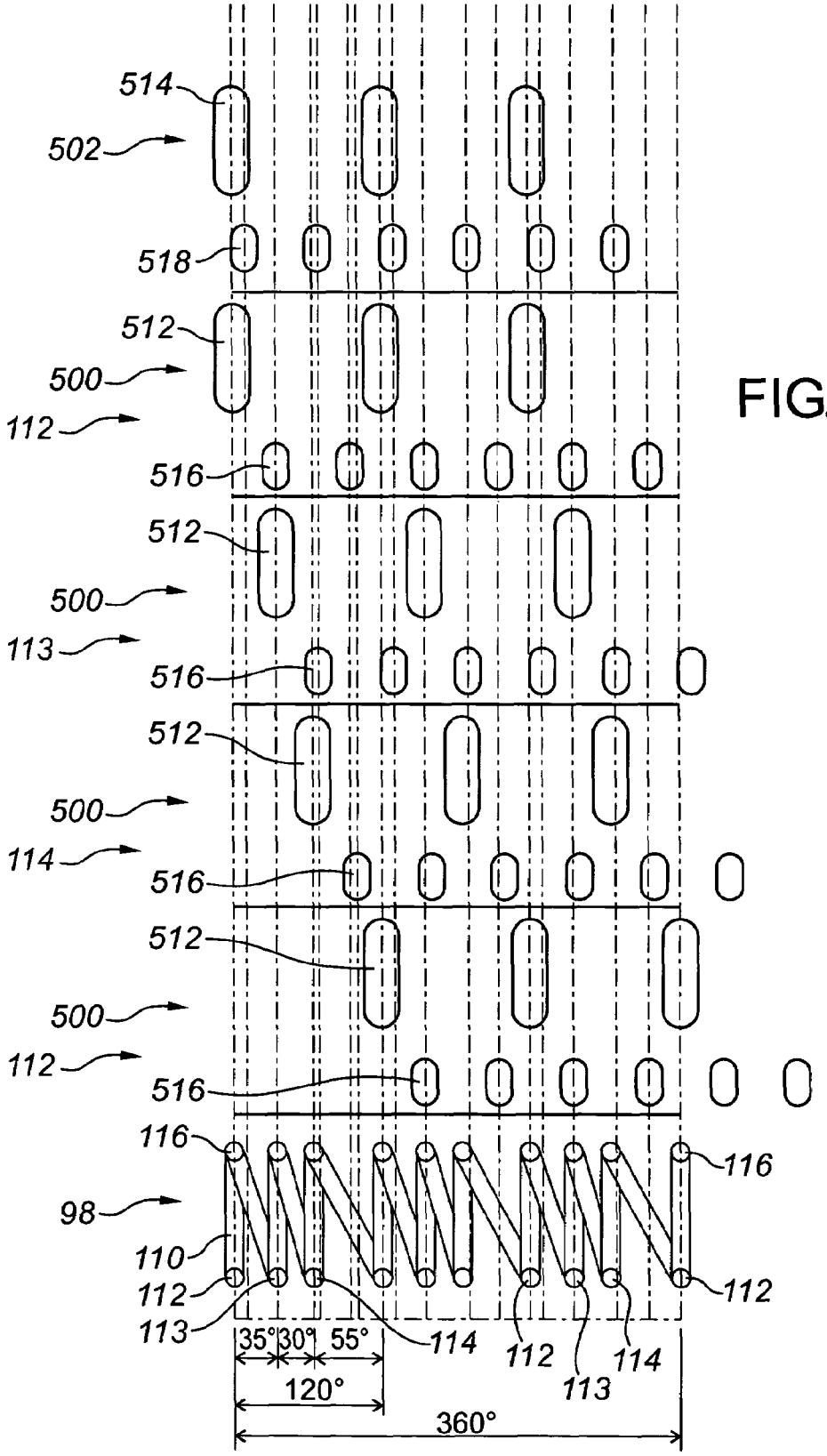
FIG. 12 is a schematic drawing relating the indexing of the actuator to the alignment and misalignment of the primary bypass ports and the secondary bypass ports for the apparatus depicted in FIG. 10.

FIGS. 10, 11 and 12 depict a second variant of the second preferred embodiment of the apparatus (20). In this embodiment, the flow control valve mechanism (366) is actuated by rotary or rotational movement instead of by longitudinal movement.

FIG. 10 depicts the actuator sub assembly (36) and the flow control sub assembly (304) of the apparatus (20). The actuator sub assembly (36) includes components of the actuator (32). The flow control sub assembly (304) includes the flow control valve mechanism (366). As in the first variant of the second preferred embodiment, the flow control valve mechanism (366) alters the flow rate of the fluid (21) through the flow path (24) by selectively directing a portion of the fluid (21) through the flow path bypass (362) instead of through the flow path (24).

In the second variant of the second preferred embodiment the flow control valve mechanism (366) is comprised of a first flow control valve member (500) and a second flow control valve member (502). The first flow control valve member (500) includes an upper nose section (504) and a lower receptacle section (506). An upper end (508) of the second flow control valve member (502) is received within the lower receptacle section (506) of the first flow control valve member (500). A lower end (509) of the second flow control valve member (502) is connected with the housing (49). The second flow control valve member (502) defines an upper end (510) of the flow path bypass (362). The flow path bypass (362) terminates at the upper end (508) of the second flow control valve member (502).

The first flow control valve member (500) defines a primary first member bypass port (512) which comprises a plurality of discrete apertures spaced circumferentially around the lower receptacle section (506) of the first flow control valve member (500). The first flow control valve member (500) also defines a secondary first member bypass port (514) which comprises a plurality of discrete apertures spaced circumferentially around the lower receptacle section (506) of the first flow control valve member (500).

The second flow control valve member (502) defines a primary second member bypass port (516) which comprises a plurality of discrete ports spaced circumferentially around the second flow control valve member (502). The second flow control valve member (502) also defines a secondary second member bypass port (518) which comprises a plurality of discrete ports spaced circumferentially around the second flow control valve member (502). The second member bypass ports (516, 518) both communicate with the flow path bypass (362).

The first flow control valve member (500) and the second flow control valve member (502) are capable of rotation relative to each other. Either or both of the valve members (500, 502) may be configured to rotate. In the preferred embodiment, the first flow control valve member (500) is capable of rotation relative to the second flow control valve member (502) and the second flow control valve member (502) is fixed to the housing (49) so that it does not rotate relative to the housing (49).

Referring to FIGS. 10 and 12, the first flow control valve member (500) is rotated relative to the second flow control valve member (502) in order to selectively align and/or misalign the primary bypass ports (512, 516) and/or the secondary bypass ports (514, 518) and thus actuate the flow control valve mechanism (366) between the first position, the second position and an intermediate position. If the intermediate position is not required, either the primary bypass ports (512, 516) or the secondary bypass ports (514, 518) may be omitted from the flow control valve mechanism (366).

Referring to FIG. 12, the primary bypass ports (512, 516) may be comprised of any number of apertures and/or ports which is suitable to produce the desired bypass flow rate or pressure drop through the flow path (24) when the primary bypass ports (512, 516) are aligned. Preferably the number of apertures comprising the primary first member bypass port (512) is the same as the number of ports comprising the primary second member bypass port (516). Similarly, the secondary bypass ports (514, 518) may be comprised of any number of apertures and/or ports which is suitable to produce the desired bypass flow rate or pressure drop through the flow path (24) when the secondary bypass ports (514, 518) are aligned.

Preferably the number of apertures comprising the secondary first member bypass port (514) is the same as the number of ports comprising the secondary second member bypass port (518). In the preferred embodiment as depicted in FIGS. 10 to 12, the primary first member bypass port (512) is comprised of three apertures, the primary second member bypass port (516) is comprised of three ports, the secondary first member bypass port (514) is comprised of six apertures, and the secondary second member bypass port (518) is comprised of six ports.

As depicted in FIGS. 10 and 12, the primary bypass ports (512, 516) are aligned when the flow control valve mechanism (366) is in the first position and are misaligned when the flow control valve mechanism (366) is in the second position or the intermediate position. In addition, as depicted in FIGS. 10 and 12, the secondary bypass ports (514, 518) are aligned when the flow control valve mechanism (366) is in the intermediate position and are misaligned when the flow control valve mechanism (366) is in the first position or the second position. Alternate configurations of the flow control valve mechanism (366) may, however be employed having regard to the overall configuration of the apparatus (20), the flow path (24) and the flow path bypass (362).

As depicted in FIGS. 10, 11 and 12, the bypass flow rate is higher when the primary bypass ports (512, 516) are aligned than when the secondary bypass ports (514, 518) are aligned. The bypass flow rate when the flow control valve mechanism (366) is in the first position is dependent in part upon the total area of the primary bypass ports (512, 516). The bypass flow rate when the flow control valve mechanism (366) is in the intermediate position is dependent in part upon the total area of the secondary bypass ports (514, 518). As a result, the total area of the primary bypass ports (512, 516) is preferably greater than the total area of the secondary bypass ports (514, 518).

As depicted in FIGS. 10 and 11, the bypass flow rate when the flow control valve mechanism (366) is in the intermediate position is also dependent upon the geometry of the flow path bypass (362) downstream of the secondary bypass ports (514, 518) and upstream of the primary bypass ports (512, 516). In the preferred embodiment, the second flow control valve member (502) is provided with a nozzle (520) which is positioned within the flow path bypass (362) upstream of the primary bypass ports (512, 516). The nozzle (520) facilitates adjustment or fine tuning of the bypass flow rate in the intermediate position of the flow control valve mechanism (366). The nozzle (520) may be removable and/or adjustable so that adjustments can be made to the nozzle either in the field or while the apparatus (20) is being assembled. In the preferred embodiment the nozzle (520) is threadably connected within the flow path bypass (362) and is preferably removable from the lower end (509) of the second flow control valve member (502).

The characteristics of the nozzle (520) may affect the desired total area of the secondary bypass ports (514, 518). For example, the use of the nozzle (520) in the apparatus (20) may permit a greater total area for the secondary bypass ports (514, 518) than would be desirable if the bypass flow rate was dependent only upon the total area of the secondary bypass ports (514, 518).

Referring to FIG. 11, the first flow control valve member (500) includes a lower end (524) which engages with a shoulder (526) on the second flow control valve member (502). The first flow control valve member (500) is maintained in position relative to the second flow control valve member (502) by dowel pins (527) which extend through the first flow control valve member (500) and engage with a circumferential groove (529) in the outer surface of the second flow control valve member (502), thus maintaining the engagement of the lower end (524) of the first flow control valve member (500) with the shoulder (526) on the second flow control valve member (502).

In the preferred embodiment the flow control device (306) is further comprised of an indexing guide mechanism which is associated with the interface between the lower end (524) of the first flow control valve member (500) and the shoulder (526) on the second flow control valve member (502). The purpose of the indexing guide mechanism is to provide a positive alignment or misalignment of the bypass ports (512, 514, 516, 518) in each of the first position, the second position and the intermediate position of the flow control valve mechanism (366).

The indexing guide mechanism is preferably comprised of a detent mechanism (528). In the preferred embodiment the detent mechanism (528) is comprised of a plurality of detents (530) and a plurality of complementary recesses (532). However, alternately, the detent mechanism (528) may be comprised of a single detent (530) and a single complementary recess (532). In the preferred embodiment the detents (530) are associated with the second flow control valve member (502) and the recesses (532) are associated with the first flow control valve member (500). Alternatively the detents (530) could be associated with the first flow control valve member (500) and the recesses (532) could be associated with the second flow control valve member (502).

Each of the detents (530) extends through the second flow control valve member (502) and is comprised of a detent ball (534), a detent plunger (536), a detent spring (538) and a detent plug (540). The detent ball (534) is biased by the detent spring (538) so that it protrudes from the shoulder (526) on the second flow control valve member (502). The recesses (532) are compatible with the detent balls (534) so that the detent balls (534) can engage with the recesses (532).

The detents (530) and the recesses (532) are configured so that each of the detent balls (534) are engaged with a recess (532) when the flow control valve mechanism (366) is actuated to one of the first position, the second position or the intermediate position, but are disengaged from a recess (532) when the flow control valve mechanism (366) is between positions. The amount of rotational force or torque required to disengage the detent balls (534) from the recesses (532) may be adjusted by altering the stiffness of the detent spring (538), the length of the detent plunger (536) or the length of the detent plug (540).

The flow control valve mechanism (366) is actuated by the actuator (32). More particularly, the first flow control valve member (500) is rotated by the actuator (32) in order to actuate the flow control valve mechanism (366) between the first position, the second position and the intermediate position.

The actuator (32) in the second variant of the second preferred embodiment may be comprised of any actuator (32) which is capable of rotating the first flow control valve member (500) and thus actuate the flow control valve mechanism (366) as described above.

For example, referring to FIGS. 10 and 12, the actuator (32) may be comprised of an actuator (32) which is similar to the actuator (32) described with respect to the first preferred embodiment and the first variant of the second preferred embodiment, adapted to provide for a rotational actuation movement instead of a longitudinal actuation movement and adapted to provide for rotational indexing instead of longitudinal indexing.

Referring to FIG. 10, in the second variant of the second preferred embodiment the barrel cam (98) is contained within the housing (49). The barrel cam (98) is fixedly connected with the barrel cam mandrel (100) so that rotation of the barrel cam (98) results in rotation of the barrel cam mandrel (100). In other words, the barrel cam (98) is not rotatably supported on the barrel cam mandrel (100) with thrust bearings as in previous embodiments. As in previous embodiments, however, the spring cap (132) communicates with the apparatus bore (27) to effect downward axial movement of the barrel cam mandrel (100) when a predetermined pressure of the fluid (21) is exerted thereon. The axial movement of the barrel cam mandrel (100) is limited by a stop collar (541) which is contained within the housing (49).

The first flow control valve member (500) is slidingly engaged with the barrel cam mandrel (100) such that the first flow control valve member (500) rotates with the barrel cam mandrel (100) without undergoing axial movement. As a result, rotation of the barrel cam mandrel (100) causes rotation of the first flow control valve member (500) but axial movement of the barrel cam mandrel (100) does not cause axial movement of the first flow control valve member (500).

The required engagement of the first flow control valve member (500) with the barrel cam mandrel (100) may be achieved in any suitable manner. In the preferred embodiment the upper nose section (504) of the first flow control valve member (500) is provided with a plurality of ribs (542) which engage with complementary grooves (544) in the inner surface of the barrel cam mandrel (100).

The spring cap (132) at the upper end (102) of the barrel cam mandrel (100) is provided with an upper mandrel chamber seal (546) and an upper mandrel chamber wiper (548) which inhibit the ingress of the fluid (21) into the mandrel chamber (105). Similarly, the lower end (104) of the barrel cam mandrel (100) is provided with a lower bulkhead (550) and a lower mandrel chamber seal (552) which inhibit the ingress of the fluid (21) into the mandrel chamber (105). The mandrel chamber (105) may be filled with a lubricating fluid, with the fluid (21), or with any other suitable fluid.

In the preferred embodiment the spring cap (132), the upper mandrel chamber seal (546), the lower bulkhead (550) and the lower mandrel chamber seal (552) provide a loose tolerance seal between the housing (49) and the barrel cam mandrel (100). As a result, the drag forces resisting axial movement of the barrel cam mandrel (100) are minimized, but some leakage from the mandrel chamber (105) may result during use of the apparatus (20). Alternatively, close tolerance seals may be provided to reduce leakage, but this may result in unacceptable drag forces being exerted on the barrel cam mandrel (100).

The required sealing force for close tolerance seals and thus the drag forces may potentially be reduced to some extent by providing the mandrel chamber (105) with a pressure balancing system such as that described with respect to the first preferred embodiment, including the balancing piston chamber (140) and the balancing piston (142). This however, may increase the overall length and complexity of the apparatus (20).

In any event, allowance needs to be made for variations in the volume of the mandrel chamber (105) due to the movement of the spring cap (132). The variation in the volume of the mandrel chamber (105) may be accommodated or allowed for by any suitable mechanism. Preferably, one or more holes (not shown) are provided in the stop collar (541) to permit communication of fluid across the stop collar (541), between the sides of the stop collar (541), as the volume of the mandrel chamber (105) varies upon movement of the spring cap (132).

As in previous embodiments, the barrel cam (98) will move axially and will rotate relative to the housing (49) as a result of axial movement of the barrel cam mandrel (100), due to engagement with the barrel cam pin (124) with the groove (110). Referring to FIG. 12, the first position (112) in the groove (110) will correspond to the first position of the flow control valve mechanism (366), the second position (114) in the groove (110) will correspond to the second position of the flow control valve mechanism (366), and the intermediate position (113) in the groove (110) will correspond to the intermediate position of the flow control valve mechanism (366). As in previous embodiments, the third position (116) in the groove corresponds to a maximum upward position of the barrel cam (98) in which the apparatus (20) is in a rest position.

Referring to FIG. 12, an exemplary barrel cam (98) timing map according to the second variant of the second preferred embodiment is depicted. The barrel cam (98) timing map provides a flat view or a "rolled out" view depicting each of the first flow control valve member (500), the second flow control valve member (502) and the barrel cam (98), including the alignment and/or misalignment of the bypass ports (512, 514, 516, 518) in the first position (112), the second position (114) and the intermediate position (113) during one complete actuation cycle of the flow control valve mechanism (366).

As depicted in FIG. 12, the flow control valve mechanism (366) moves through three complete actuation cycles for a single revolution of the barrel cam (98). In other words, in a single revolution of the barrel cam (98) the first position (112), the second position (114) and the intermediate position (113) of the barrel cam (98) will each be provided three times, with the result that a single cycle will be completed in each 120 degrees of rotation of the barrel cam (98).

It is advantageous to minimize the amount of rotation of the barrel cam (98) required to actuate the flow control valve mechanism (366) between the various positions, since this will increase the steepness or slope of each segment of the groove (110) and thus reduce the resistance to rotation of the barrel cam (98) provided by the engagement of the barrel cam pin (124) in the groove (110).

However, the amount of rotation of the barrel cam (98) between positions should be sufficient to provide adequate clearance of the bypass ports (512, 514, 516, 518) when they are misaligned to prevent erosion of the bypass ports (512, 514, 516, 518) and must also simultaneously accommodate the desired sequencing of alignment and misalignment of both the primary bypass ports (512, 516) and the secondary bypass ports (514, 518).

The above design considerations will be influenced by the diameter of the barrel cam (98) and thus the length of the groove (110), the number and size of the bypass ports (512, 514, 516, 518), and the number of actuation cycles which occur for a single revolution of the barrel cam (98). The above design considerations may also result in a barrel cam (98) timing map in which the barrel cam (98) rotates different amounts during the various actuation steps in the actuation cycle. For example, in the preferred embodiment as depicted in FIG. 12, the barrel cam (98) rotates 35 degrees from the first position (112) to the intermediate position (113), 30 degrees from the intermediate position (113) to the second position (114) and 55 degrees from the second position (114) back to the first position (112).

Figure 7:
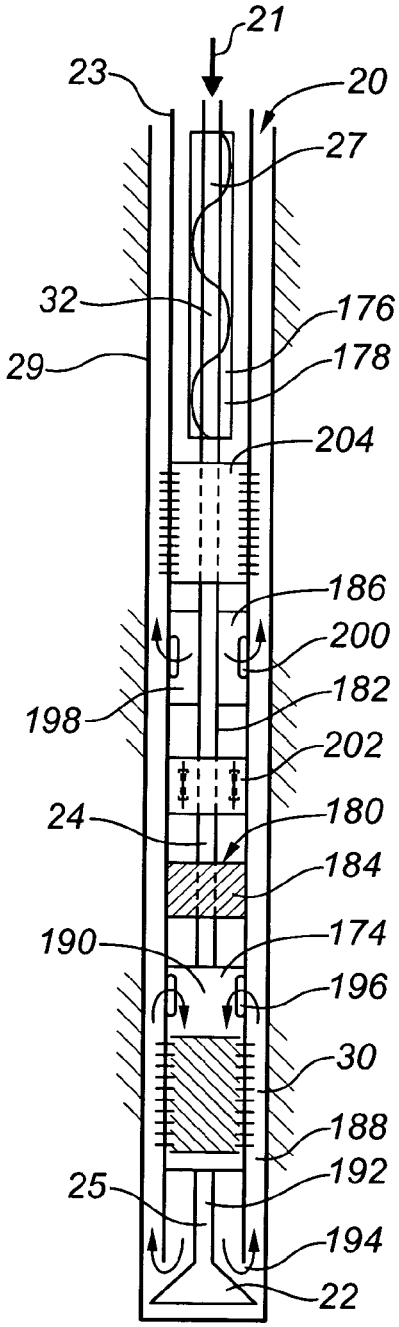
FIG. 7 is a schematic view of an alternate preferred embodiment of an apparatus according to the invention which includes a mixing device as a pressure drop device and a recirculation mechanism, wherein the apparatus is depicted connected into a working string and extending within a borehole.
Figure 8:
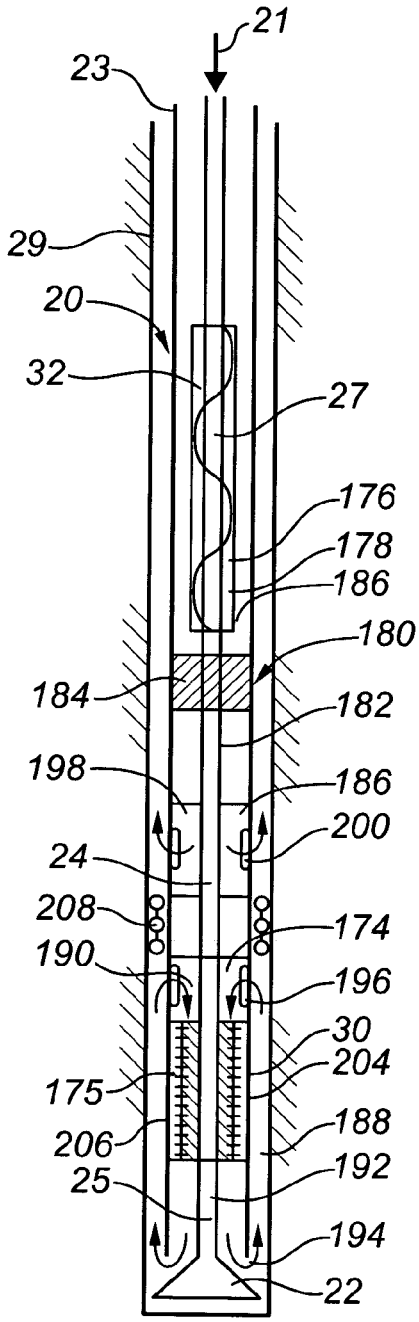
FIG. 8 is a schematic view of a alternate configuration of the alternate preferred embodiment of the apparatus depicted in FIG. 7.
Figure 9A:
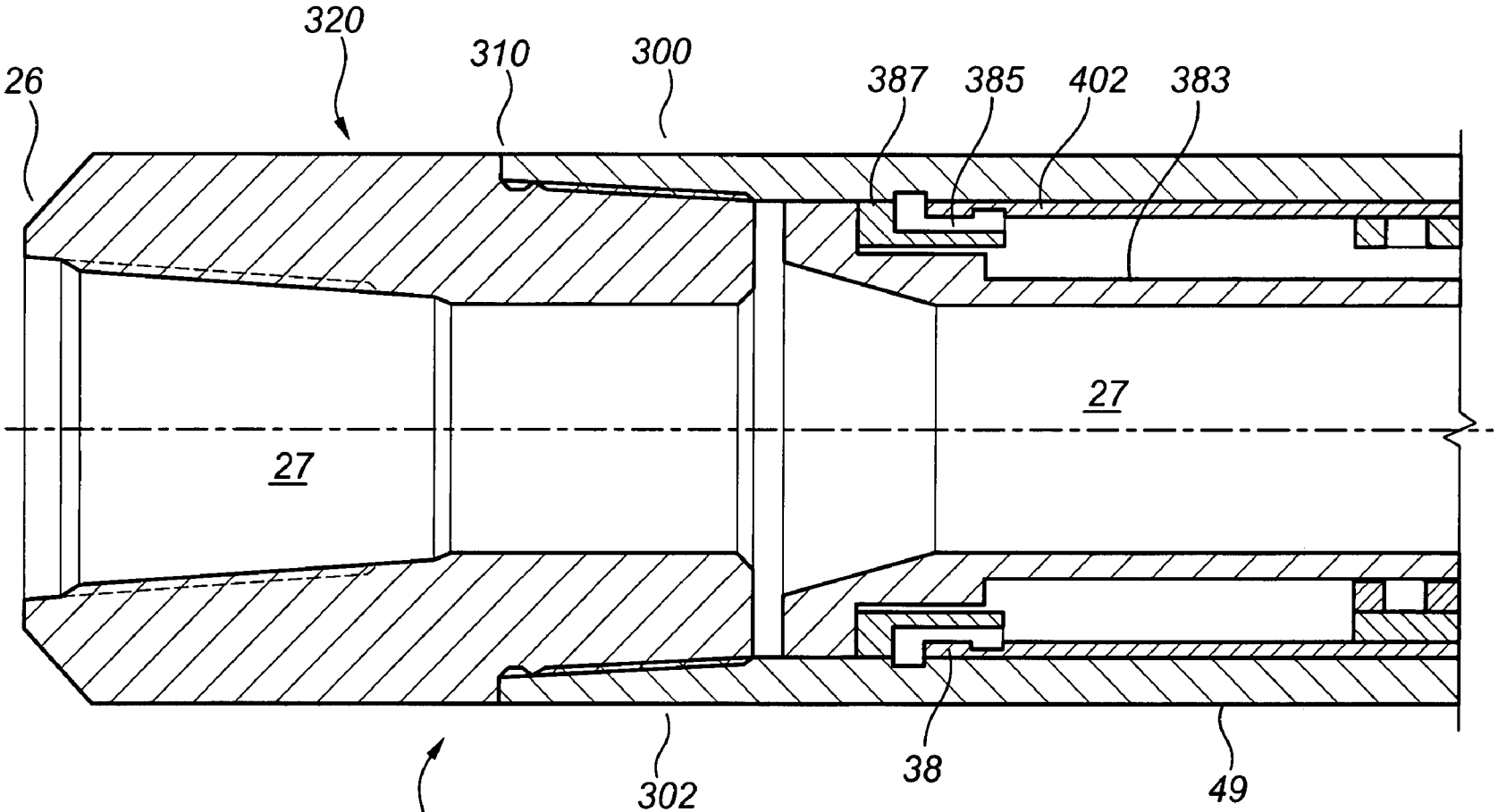
FIG. 9 is a split longitudinal section view of a first variant of an alternate preferred embodiment of an apparatus according to the invention which includes a flow control device, wherein FIGS. 9(*b*) through (*d*) are down hole continuations of FIGS. 9(*a*) through 9(*c*) respectively, and wherein one side of the apparatus is depicted as actuated to the maximum pressure drop position and the other side of the apparatus is depicted as actuated to an intermediate pressure drop position.
Figure 9B:
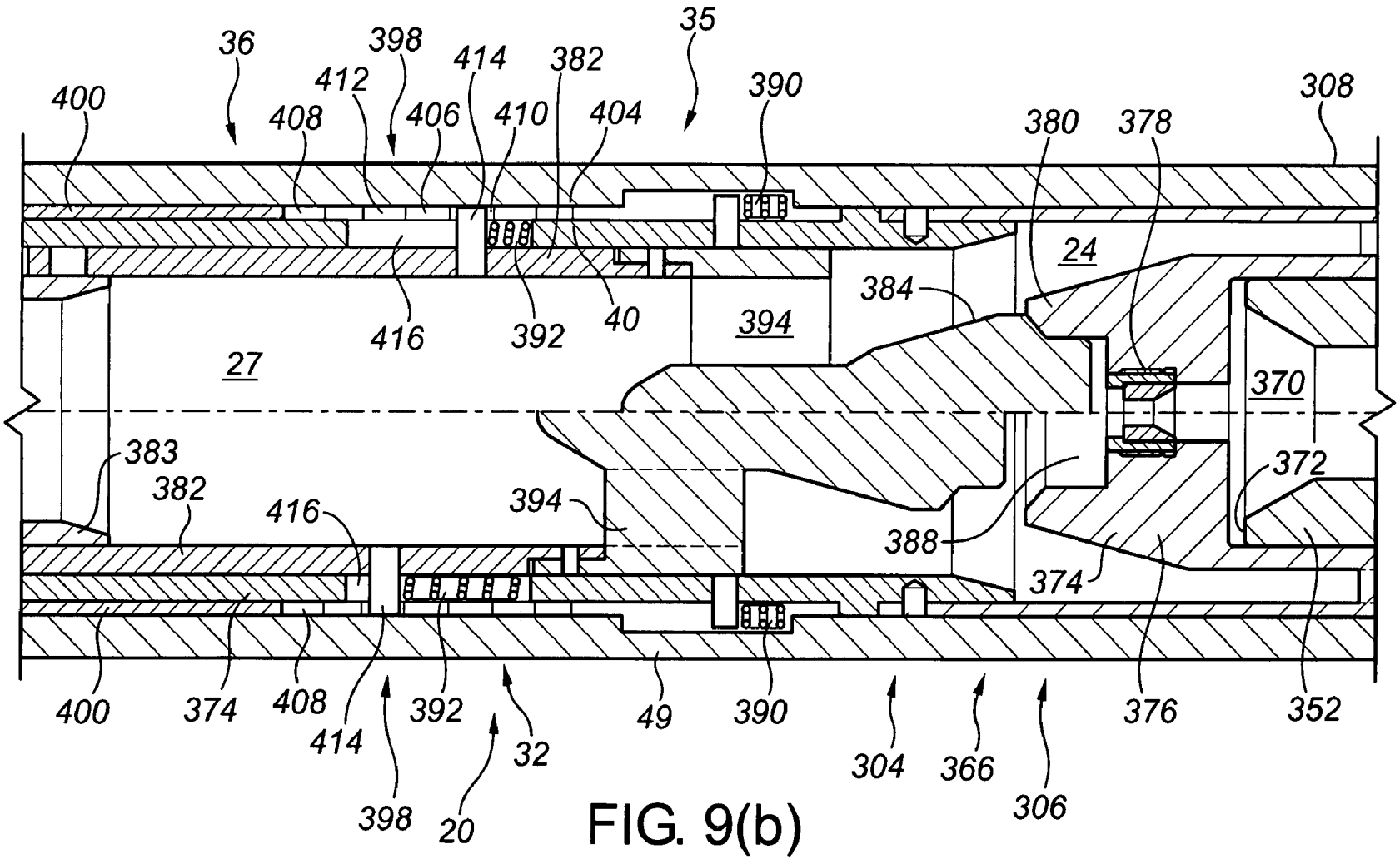
Figure 9C:
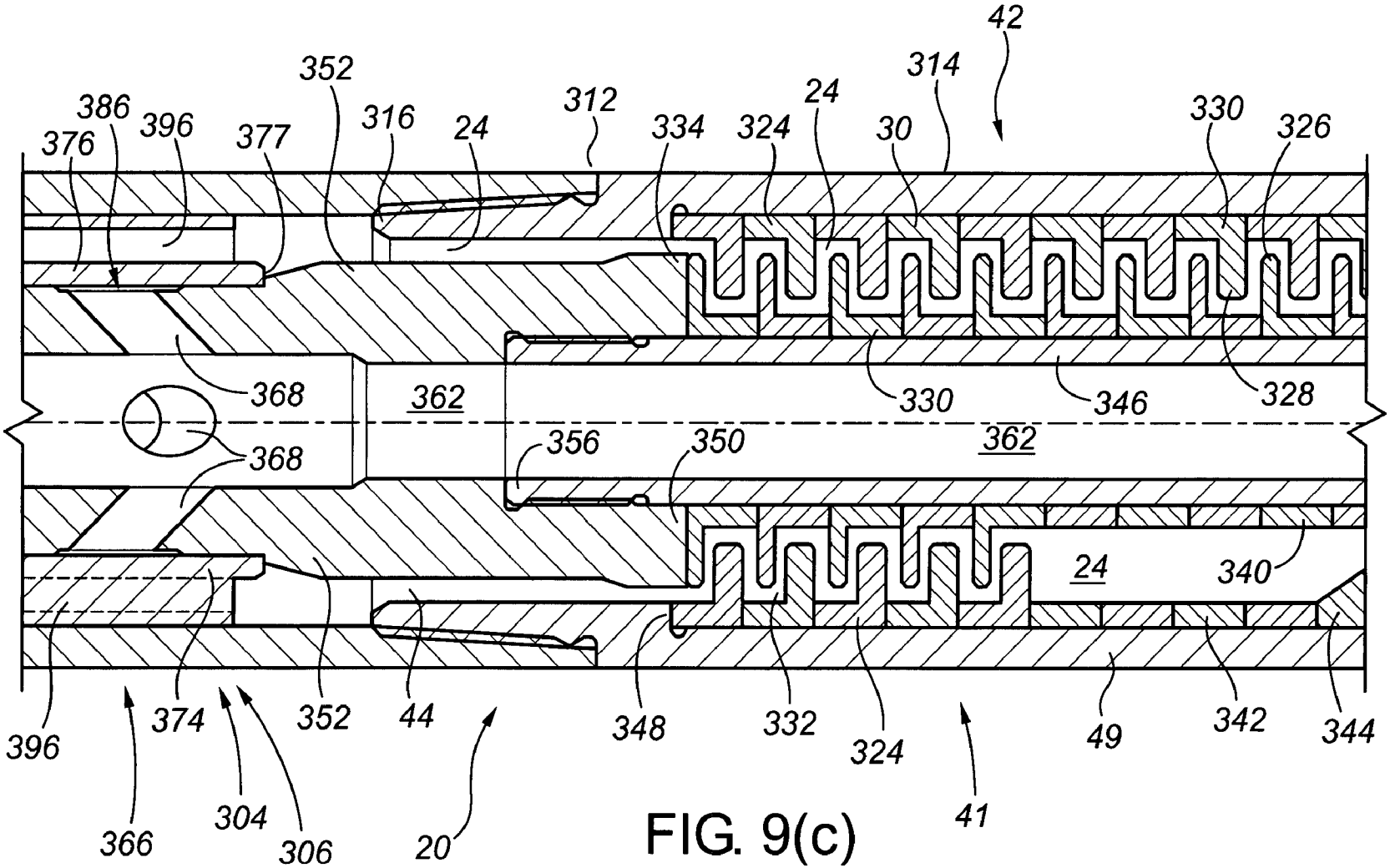
Figure 9D:
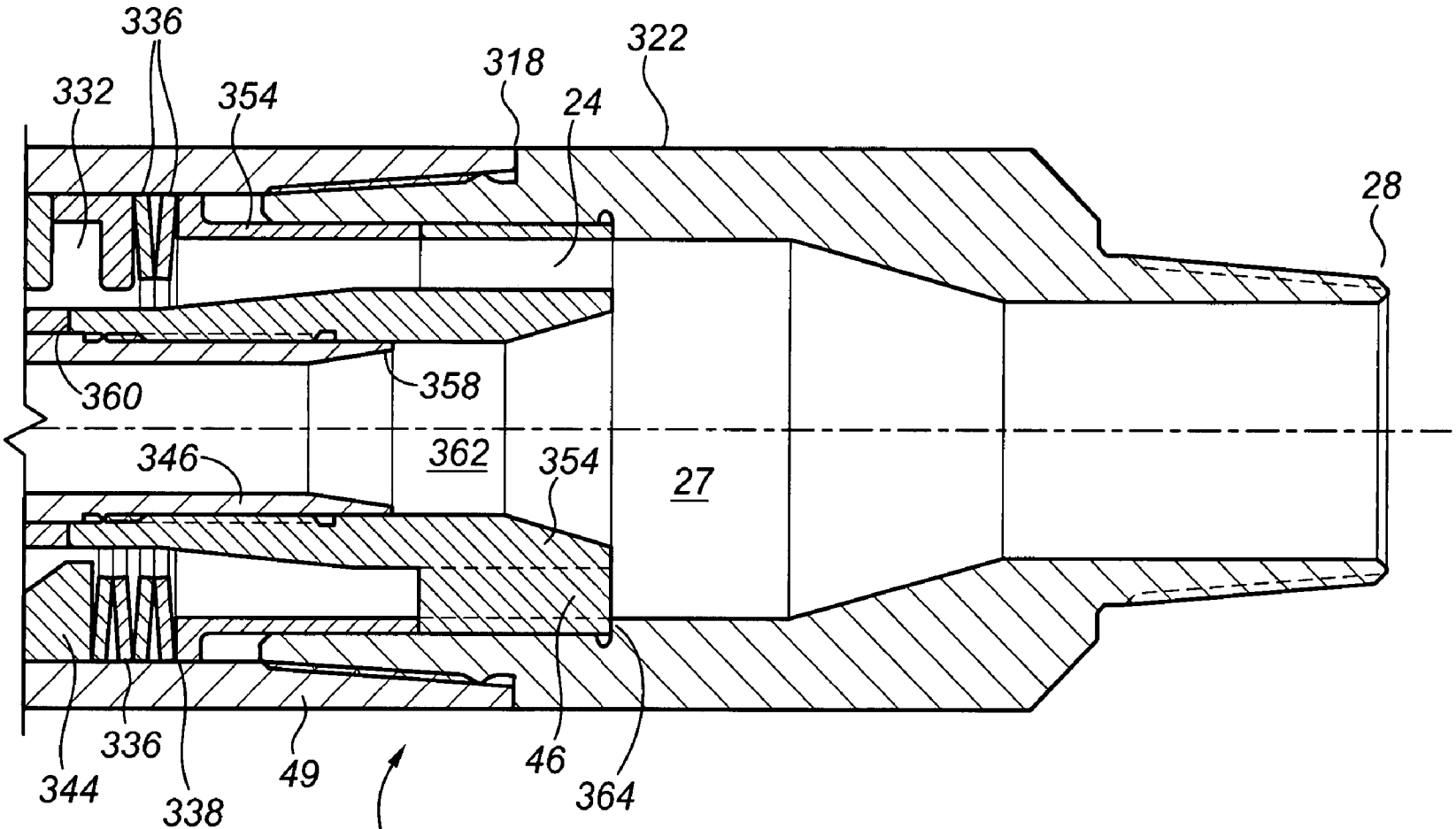

FIGS. 7 and 8 depict a third preferred embodiment of the apparatus (20), wherein FIGS. 7 and 8 show alternate configurations with respect to this third preferred embodiment. In these configurations of the third preferred embodiment, the apparatus (20) continues to be comprised of the pressure drop device (30) and the actuator (32) as described generally above. However, the pressure drop device (30) is comprised of a mixing device (174), wherein the mixing device (174) is positioned in the flow path (24). The mixing device (174) may be comprised of any mechanism or device capable of mixing the fluid (21) to provide a sufficient shearing of the fluid to generate heat therefrom. For instance, the mixing device (174) may be comprised of a high shear mixer, a turbine or a pump.

Preferably in the configurations of the third preferred embodiment, the mixing device (174) is comprised of a centrifugal pump. A centrifugal pump is preferred due to its general robustness and decreased likelihood of clogging as compared with other types of pump. Specifically, the centrifugal pump is preferably comprised of a plurality of vanes, which turn or rotate about its longitudinal axis within the apparatus (20), and particularly within the second section (41) of the apparatus (20) defining the pressure drop sub assembly (42). The rotation or spinning of the vanes of the centrifugal pump provides energy to the fluid (21) within the mixing device (174).

Thus, the second section (41) of the apparatus (20) defines the flow path (24), wherein the mixing device (174) is positioned within the flow path (24) such that the fluid (21) travels or flows through the mixing device (174). The shearing action of the mixing device (174) provides energy to the fluid (21) as it passes through the mixing device (174).

The mixing device (174) alone may comprise the pressure drop device (30) of the apparatus (20). However, alternately, the mixing device (174) may be used in combination with the valve mechanisms (34) described above. Thus, the pressure drop device (30) may be comprised of both the valve mechanisms (34) and the mixing device (174). The structures of valve mechanisms (34) and the mixing device (174) may be adapted in any suitable manner to permit for their combination. For instance, the valve mechanisms (34), including the orifice assembly (60) and the poppet shaft (80), and the mixing device (174) may simply be connected in series axially along the drill string (23) such that the fluid (21) passes through each of these devices (34, 174) in turn as it flows through the apparatus (20).

However, alternately, the mixing device (174) may be positioned circumferentially about the valve mechanisms (34). For instance, in this case, the flow path (24) will be defined, as described above, between the orifice assembly (60) and the poppet shaft (80). Thus the fluid (21) will flow through the flow path (24) to exit from the lower end (28) of the apparatus (20). The mixing device (174) will be positioned circumferentially between the outer surface of the orifice assembly (60) and the inner surface of the housing (49) in a manner defining a secondary flow path (175) through the mixing device (174) extending from a position below the down hole end of the orifice assembly (60) to a position above the up hole end of the orifice assembly (60). Preferably, the mixing device (174) is comprised of a centrifugal pump such that the vanes of the pump rotate within the secondary flow path (175). As a result, a portion of the fluid (21) exiting the orifice assembly (60) down hole flows into the secondary flow path (175) by the pump and is conducted to a position up hole of the orifice assembly (60) for communication with the flow path (24) through the orifice assembly (60). Thus, further heat may be provided to the fluid (21).

Referring to FIGS. 7 and 8 of the third preferred embodiment of the apparatus (20), the actuator (32) may be any mechanism or device capable of actuating the mixing device (174), either alone or in combination with the valve mechanisms (34). Preferably, the actuator (32) is comprised of a source of power (176) for driving the mixing device (174). Although any power source may be used, the source of power (176) is preferably comprised of a rotary drilling motor (178) for driving the mixing device (174).

Further, the actuator (32) is preferably comprised of a transmission (180) for transmitting power from the rotary drilling motor (178) to the mixing device (174). Specifically, the transmission (180) is comprised of a drive shaft (182) operatively connected with and extending between the rotary drilling motor (178) and the mixing device (174). In addition, where desired or required to sufficiently actuate the rotary drilling motor (178), the transmission (180) may be further comprised of a gearing up gearbox (184) for increasing the speed of rotation of the mixing device (174) as compared to the speed of rotation of the rotary drilling motor (178).

Further, in these configurations of the third preferred embodiment, the actuator (32) is further comprised of a switch mechanism (186) for activating and deactivating the source of power (176). Preferably, the switch mechanism (186) is controlled by a pressure exerted by the fluid (21) on the switch mechanism (186). Although any pressure actuated switch mechanism may be used, the preferred switch mechanism (186) is comprised of a piston which is movable longitudinally in response to pressure exerted on the piston by the fluid (21).

More particularly, longitudinal movement of the switch mechanism (186) causes the fluid (21) to be directed either through the rotary drilling motor (178), thus activating the source of power (176) for the mixing device (174), or diverted from the rotary drilling motor (178), thus deactivating the source of power (176) for the mixing device. (174). Accordingly, the actuator (32), and thus the mixing device (174), may be controlled by varying the pressure exerted by the fluid (21) on the piston of the switch mechanism (186).

The various embodiments of the apparatus (20) can provide different advantages. The first preferred embodiment of the apparatus (20) provides the advantage that all of the fluid (21) being passed through the apparatus (20) is subjected to the provision of heat energy. The second preferred embodiment of the apparatus (20) provides the advantage that the actuator (32) is only required to actuate the flow control device (306) and not the pressure drop device (30), thus potentially reducing the design requirements for the actuator (32). The third preferred embodiment of the apparatus (20) provides the advantage that all of the fluid (21) being passed through the apparatus (20) is subjected to the provision of heat energy and the potential advantage of a relatively more efficient provision of heat energy by the mixing device in comparison with the valve mechanism (34) of the first preferred embodiment and the orifice assembly (324) of the second preferred embodiment.

In any of the embodiments of the apparatus (20) described herein, the apparatus (20) may be further comprised of a recirculation mechanism (188) for recirculating at least a portion of the fluid (21) after the fluid (21) exits the pressure drop device (30), in order to effect the further providing of heat from or to the fluid (21). The fluid (21) may be recirculated back through all or a portion of the flow path (24) or may be recirculated adjacent to the flow path (24) in a manner such that heat the providing of heat by conduction can be effected between recirculated fluid (21) and fluid (21) passing through the flow path (24).

Thus, for instance, in the first preferred embodiment of the apparatus (20) shown in FIG. 1, at least a portion of the fluid (21) exiting the lower end (46) of the pressure drop sub assembly (42) may be recirculated back to a position up hole of the upper end (44) of the pressure drop sub assembly (42). More particularly, at least a portion of the fluid (21) may be recirculated from the flow path (24) at a position down hole or downstream of the valve mechanisms (34), being downstream of the orifice assembly (60) and the poppet shaft (80) in the preferred embodiment. The portion of the fluid (21) recirculated is conducted back to the flow path (24) at a position up hole or upstream of the valve mechanisms (34), being upstream of the orifice assembly (60) and the poppet shaft (80) in the preferred embodiment.

For instance, the plurality of valve mechanisms (34) define or comprise an upstream side, being above or up hole of the valve mechanisms (34), and a downstream side, being below or down hole of the valve mechanisms (34). The recirculation mechanism (188) may thus be comprised of an outlet port in communication with the downstream side of the valve mechanisms (34) and a recirculation port in communication with the upstream side of the valve mechanisms (34).

In the second preferred embodiment of the apparatus (20) shown in FIGS. 9 to 12, at least a portion of the fluid (21) exiting the lower sub (322) may be recirculated back to a position up hole of the pressure drop sub assembly (42). More particularly, at least a portion of the fluid (21) may be recirculated from either or both of the flow path (24) and the flow path bypass (362) at a position downstream of the pressure drop device (30). The recirculated portion of the fluid (21) may be conducted directly back to the flow path (24) or may be conducted to the apparatus bore (27) and thus be subjected to control by the flow control valve mechanism (366).

As in the case of the first preferred embodiment, the pressure drop device (30) in the second preferred embodiment may define or comprise an upstream side and a downstream side and the recirculation mechanism (188) may be comprised of an outlet port in communication with the downstream side of the pressure drop device (30) and a recirculation port in communication with the upstream side of the pressure drop device (30).

In the third preferred embodiment of the apparatus (20) shown in FIGS. 7 and 8, at least a portion of the fluid (21) exiting the lowermost end of the mixing device (174) may be recirculated back to a position up hole of the mixing device (174). More particularly, at least a portion of the fluid (21) may be recirculated from the flow path (24) at a position down hole or downstream of the mixing device (174). The portion of the fluid (21) recirculated is conducted back to the flow path (24) at a position up hole or upstream of the mixing device (174).

For instance, the mixing device (174) may define or be comprised of an upstream side (190), being above or up hole of the mixing device (174), and a downstream side (192), being below or down hole of the mixing device (174). The recirculation mechanism (188) shown in FIGS. 7 and 8 for this embodiment may thus be comprised of an outlet port (194) in communication with the downstream side (192) of the mixing device (174) and a recirculation port (196) in communication with the upstream side (190) of the mixing device (174).

Therefore, the recirculation mechanism (188) is intended to add thermal energy to the fluid (21) incrementally by creating a substantially "closed loop" system wherein the fluid (21) to be heated will be recirculated continuously, adding extra thermal energy with each successive pass through the apparatus (20). As a result, a lower level of input energy may be required on the surface to actuate the apparatus (20) and over a period of time, the temperature of the fluid (21) may be driven higher than would be possible with one pass through the pressure drop device (30) without a recirculation mechanism (188).

More particularly, in a first configuration of the third preferred embodiment of the apparatus (20) as shown in FIG. 7, the apparatus (20) is comprised of several subassemblies. In particular, the rotary drilling motor (178) provides motive power and torque via the driveshaft (182) through the gearbox (184) to the mixing device (174). The rotary drilling motor (178) is started and stopped by the switch mechanism (186), which is preferably a barrel cam device (198) similar to the barrel cam (98) described above with respect to the actuator (32). The barrel cam device (198) will preferably be operated via a simple pumps on/pumps off sequence from the surface. Further, the barrel cam device (198) will also simultaneously operate a ported window outlet (200) which will permit spent fluid from the rotary drilling motor (178) to return to surface.

Although a closed loop system may be preferred, this apparatus (20) will in fact be a "semi-closed loop", meaning that there will be no physical packer or other solid barrier between the upper and lower components attached to the wall of the borehole (29) to isolate flow within the annulus. The "barrier" to commingling of the upper and lower fluid streams will be a fluidic "pressure wall." In other words, pressure balancing of the two streams will be necessary to halt or minimize commingling. Therefore, the apparatus (20) includes a surface adjustable pressure balancing valve unit (202) which may be utilized to dynamically adjust the balance of pressure ratios between the upper and lower fluid streams and will be placed between the upper and lower halves of the apparatus (20), being traversed by the driveshaft (182).

Finally, to maximize the recovery of heat from any fluid (21) in the borehole (29) which escapes or bypasses the pressure balance valve (202), a heat exchanger (204) may be utilized. Any suitable, known heat exchanger (204) may be used for this purpose.

In a second configuration of the third preferred embodiment of the apparatus (20) as shown in FIG. 8, all of the fluid (21) may be looped through a mixing device (174) and a heat exchanger (204) which are combined as a unit to provide a combined mixer/heat exchanger unit (206) thereby conducting the heat generated into the flow path (24) without actual commingling of the two fluid streams. The path of the fluid (21) through the combined mixer/heat exchanger unit (206) comprises a secondary flow path (175) through the apparatus (20).

As depicted in FIG. 8, the combined mixer/heat exchanger unit (206) is configured to operate co-current with the flow of the fluid (21) through the flow path (24). The combined mixer/heat exchanger unit (206) may, however, be configured as a fluid-fluid counter-flow type which will tend to be relatively more efficient due to its manner of operation.

In this case, pressure balancing may be simpler since the two independent flows would tend to equalize at ambient pressure and should therefore automatically contain and trap most of the heated fluid (21) in the lower loop by creation of a "stagnation zone" (208) between the upper and lower flow loops. Thus, the pressure balancing valve (202) may not be required. In drilling mode, the pumps would simply be cycled on/off to switch the flow to straight through the drill string (23) down to the lower BHA with a concomitant change to normal drilling pressures at the surface.

The method of the within invention may be performed using any compatible apparatus. However, the preferred embodiment of the method is preferably performed using the preferred embodiments of the apparatus (20) as described herein. The method is provided for providing heat energy to the fluid (21) using an apparatus which includes a flow path (24) and a pressure drop device (30) positioned in the flow path (24). The method is particularly comprised of the step of actuating the apparatus toward a maximum pressure drop position.

In a first preferred embodiment, the pressure drop device (30) is comprised of at least one valve mechanism (34), and preferably a plurality of valve mechanisms (34). In this case, the actuating step is comprised of actuating each valve mechanism (34) in order to actuate the apparatus toward the maximum pressure drop position described above.

More particularly, where each valve mechanism (34) is comprised of an orifice (56) and a corresponding flow restrictor member (58) for positioning relative to the orifice (56) to adjust the flow path (24), the actuating step is comprised of longitudinally moving the orifice (56) and the flow restrictor member (58) relative to each other. Accordingly, using the first preferred embodiment of the apparatus (20) to perform the method, the actuating step is comprised of longitudinally moving the orifice assembly (60) and the poppet shaft (80) relative to each other. In addition, the actuating step is further comprised of causing the fluid (21) to exert a pressure on an actuator (32) in order to longitudinally move the orifice (56) and the flow restrictor member (58) relative to each other.

In a second preferred embodiment, the pressure drop device (30) is comprised of an orifice assembly (324). In this case, the actuating step is comprised of actuating a flow control device (306) in order to actuate the apparatus toward the maximum pressure drop position described above. In particular, the actuating step may be further comprised of causing the fluid (21) to exert a pressure on an actuator (32) in order to actuate the flow control device (306).

In a third preferred embodiment, the pressure drop device (30) is comprised of the mixing device (174). In this case, the actuating step is comprised of activating the source of power (176) to the mixing device (174). In addition, the activating step is preferably further comprised of causing the fluid (21) to exert a pressure on the actuator (32) in order to activate the source of power (176) to the mixing device (174). Thus, using the third preferred embodiment of the apparatus (20) to perform the method, the activating step is comprised of causing the fluid (21) to exert a pressure on the switch mechanism (186) in order to activate the source of power (176) to the mixing device (174).

Finally, where desirable, the method may further be comprised of the step of recirculating at least a portion of the fluid (21).

In relation to the first preferred embodiment of the apparatus (20), the method may be comprised of the step of recirculating at least a portion of the fluid (21) back through or adjacent to the valve mechanisms (34) after the fluid (21) exits the valve mechanisms (34).

In relation to the second preferred embodiment of the apparatus (20), the method may be comprised of the step of recirculating at least a portion of the fluid (21) back through or adjacent to the orifice assembly (324) after the fluid (21) exits the orifice assembly (324).

In relation to the first configuration of the third preferred embodiment of the apparatus (20) as depicted in FIG. 7, the method may be comprised of the step of recirculating at least a portion of the fluid (21) back through the pressure drop device (30) after the fluid (21) exits the pressure drop device (30). In relation to the second configuration of the third preferred embodiment of the apparatus (20) as depicted in FIG. 8, the method may be comprised of the step of recirculating at least a portion of the fluid (21) back through a secondary flow path (175) adjacent to the flow path (24) after the fluid (21) exits the pressure drop device (30).

The embodiments of the invention in which an exclusive property or privilege is claimed are defined as follows:

1. An apparatus for providing heat energy to a fluid, the apparatus comprising:

(a) a housing adapted for connecting into a working string and for inserting into a borehole;

(b) a flow path for the fluid extending within the housing;

(c) a pressure drop device positioned within the flow path;

(d) an actuator for actuating the apparatus between a minimum pressure drop position and a maximum pressure drop position; and (e) a recirculation mechanism for recirculating at least a portion of the fluid back through the apparatus.

2. The apparatus as claimed in claim 1 wherein the pressure drop device is comprised of an upstream side and a downstream side, wherein the recirculation mechanism is comprised of an outlet port in communication with the downstream side of the pressure drop device and wherein the recirculation mechanism is comprised of a recirculation port in communication with the upstream side of the pressure drop device.

3. The apparatus as claimed in claim 1 wherein the recirculation mechanism is comprised of a secondary flow path located adjacent to the flow path so that the fluid is recirculated through the secondary flow path.

4. The apparatus as claimed in claim 1 wherein the flow path is a single flow path.

5. The apparatus as claimed in claim 4 wherein the pressure drop device is comprised of an upstream side and a downstream side, wherein the recirculation mechanism is comprised of an outlet port in communication with the downstream side of the pressure drop device and wherein the recirculation mechanism is comprised of a recirculation port in communication with the upstream side of the pressure drop device.

6. The apparatus as claimed in claim 4 wherein the recirculation mechanism is comprised of a secondary flow path located adjacent to the flow path so that the fluid is recirculated through the secondary flow path.

7. A method for providing heat energy to a fluid, the method comprising:

(a) providing an apparatus in a borehole, the apparatus comprising a flow path for the fluid and the apparatus further comprising a pressure drop device positioned within the flow path;

(b) actuating the apparatus to a maximum pressure drop position;

(c) circulating the fluid through the flow path and the pressure drop device; and (d) recirculating at least a portion of the fluid after it exits the pressure drop device.

8. The method as claimed in claim 7 wherein the flow path is a single flow path.

9. The method as claimed in claim 7 wherein the step of providing the apparatus in the borehole is comprised of inserting the apparatus in the borehole as a component of a working string.

10. An apparatus for providing heat energy to a fluid, the apparatus comprising:

(a) a housing adapted for connecting into a working string and for inserting into a borehole;

(b) a flow path for the fluid extending within the housing, wherein the flow path is a single flow path;

(c) a pressure drop device positioned within the flow path, wherein the pressure drop device is comprised of an orifice assembly, wherein the orifice assembly defines a tortuous path for the fluid through the flow path and wherein the orifice assembly is comprised of longitudinally alternating inner orifice flanges and outer orifice flanges;

(d) an actuator for actuating the apparatus between a minimum pressure drop position and a maximum pressure drop position; and (e) a flow control device for controlling a flow path flow rate of the fluid through the flow path and wherein the flow control device is actuatable by the actuator to alter the flow path flow rate in order to actuate the apparatus between the minimum pressure drop position and the maximum pressure drop position.

11. The apparatus as claimed in claim 10 wherein the orifice assembly is comprised of a plurality of longitudinally spaced orifice members.

12. An apparatus for providing heat energy to a fluid, the apparatus comprising:

(a) a housing adapted for connecting into a working string and for inserting into a borehole;

(b) a flow path for the fluid extending within the housing, wherein the flow path is a single flow path;

(c) a pressure drop device positioned within the flow path;

(d) an actuator for actuating the apparatus between a minimum pressure drop position and a maximum pressure drop position;

(e) a flow control device for controlling a flow path flow rate of the fluid through the flow path and wherein the flow control device is actuatable by the actuator to alter the flow path flow rate in order to actuate the apparatus between the minimum pressure drop position and the maximum pressure drop position; and (f) wherein the flow control device is comprised of a flow control valve mechanism, wherein the flow control valve mechanism is actuatable by the actuator between a first position corresponding to the minimum pressure drop position and a second position corresponding to the maximum pressure drop position, wherein the first position provides a minimum flow path flow rate and wherein the second position provides a maximum flow path flow rate.

13. The apparatus as claimed in claim 12 wherein the apparatus is further comprised of a flow path bypass extending within the housing for providing a bypass flow rate of the fluid through the flow path bypass, and wherein the flow control valve mechanism controls the bypass flow rate.

14. The apparatus as claimed in claim 13 wherein the first position provides a maximum bypass flow rate and wherein the second position provides a minimum bypass flow rate.

15. The apparatus as claimed in claim 14 wherein the apparatus is actuatable by the actuator between the minimum pressure drop position, the maximum pressure drop position and at least one intermediate pressure drop position.

16. The apparatus as claimed in claim 15 wherein the flow control valve mechanism is actuatable by the actuator between the first position, the second position and an intermediate position corresponding to the intermediate pressure drop position, wherein the intermediate position provides an intermediate flow path flow rate, and wherein the intermediate position provides an intermediate bypass flow rate.

17. The apparatus as claimed in claim 16 wherein the flow control valve mechanism is comprised of a first flow control valve mechanism and a second flow control valve mechanism.

18. The apparatus as claimed in claim 17 wherein the first flow control valve mechanism and the second flow control valve mechanism are sequentially actuatable by the actuator in order to provide the minimum pressure drop position, the intermediate pressure drop position and the maximum pressure drop position.

19. The apparatus as claimed in claim 17 wherein the flow control valve mechanism is actuated by applying a longitudinal movement to the flow control valve mechanism so that the first position is a first longitudinal position of the flow control valve mechanism, the intermediate position is an intermediate longitudinal position of the flow control valve mechanism, and the second position is a second longitudinal position of the flow control valve mechanism.

20. The apparatus as claimed in claim 19 wherein the first flow control valve mechanism is comprised of a bypass port communicating with the flow path bypass and a longitudinally movable bypass port sealing member for sealing the bypass port.

21. The apparatus as claimed in claim 19 wherein the second flow control valve mechanism is comprised of a bypass nozzle communicating with the flow path bypass and a longitudinally movable bypass nozzle sealing member for sealing the bypass nozzle.

22. The apparatus as claimed in claim 21 wherein the first flow control valve mechanism is comprised of a bypass port communicating with the flow path bypass and a longitudinally movable bypass port sealing member for sealing the bypass port.

23. The apparatus as claimed in claim 22 wherein the bypass port is sealed when the flow control valve mechanism is in the intermediate longitudinal position.

24. The apparatus as claimed in claim 23 wherein the bypass port and the bypass nozzle are both sealed when the flow control valve mechanism is in the second longitudinal position.

25. The apparatus as claimed in claim 24 wherein the bypass port sealing member is comprised of a bypass port sealing sleeve, wherein the bypass nozzle sealing member is comprised of a bypass nozzle sealing sleeve and wherein the bypass port sealing sleeve and the bypass nozzle sealing sleeve are concentric and longitudinally movable relative to each other.

26. The apparatus as claimed in claim 14 wherein the flow control valve mechanism is comprised of a first flow control valve member and a second flow control valve member and wherein the first flow control valve member and the second flow control valve member are rotatable relative to each other by the actuator in order to actuate the flow control valve mechanism between the first position and the second position.

27. The apparatus as claimed in claim 26 wherein the first flow control valve member is comprised of a primary first member bypass port, wherein the second flow control valve member is comprised of a primary second member bypass port, and wherein the flow control valve mechanism is actuated by rotating the first flow control valve member and the second flow control valve member relative to each other in order to selectively align and misalign the primary first member bypass port and the primary second member bypass port.

28. The apparatus as claimed in claim 27 wherein the primary first member bypass port and the primary second member bypass port are substantially aligned when the flow control valve mechanism is actuated to the first position.

29. The apparatus as claimed in claim 28 wherein the apparatus is actuatable by the actuator between the minimum pressure drop position, the maximum pressure drop position and at least one intermediate pressure drop position.

30. The apparatus as claimed in claim 29 wherein the flow control valve mechanism is actuatable by the actuator between the first position, the second position and an intermediate position corresponding to the intermediate pressure drop position, wherein the intermediate position provides an intermediate flow path flow rate, and wherein the intermediate position provides an intermediate bypass flow rate.

31. The apparatus as claimed in claim 30 wherein the first flow control valve member is comprised of a secondary first member bypass port, wherein the second flow control valve member is comprised of a secondary second member bypass port, and wherein the flow control valve mechanism is actuated by rotating the first flow control valve member and the second flow control valve member relative to each other in order to selectively align and misalign the secondary first member bypass port and the secondary second member bypass port.

32. The apparatus as claimed in claim 31 wherein the secondary first member bypass port and the secondary second member bypass port are substantially aligned when the flow control valve mechanism is actuated to the intermediate position.

33. The apparatus as claimed in claim 14 wherein the pressure drop device is comprised of an orifice assembly.

34. The apparatus as claimed in claim 33 wherein the orifice assembly defines a tortuous path for the fluid through the flow path.

35. The apparatus as claimed in claim 34 wherein the orifice assembly is comprised of longitudinally alternating inner orifice flanges and outer orifice flanges.

36. The apparatus as claimed in claim 35 wherein the orifice assembly is comprised of a plurality of longitudinally spaced orifice members.

37. A method for providing heat energy to a fluid, the method comprising:

(a) providing an apparatus in a borehole, the apparatus comprising:
  (i) a flow path for the fluid, wherein the flow path is a single flow path;
  (ii) a pressure drop device positioned within the flow path;
  (iii) a flow control device for controlling a flow path flow rate of the fluid through the flow path;

(b) actuating the apparatus to a maximum pressure drop position comprising actuating the flow control device, wherein the flow control device is comprised of a flow control valve mechanism, wherein the flow control valve mechanism is actuatable between a first position corresponding to a minimum pressure drop position of the apparatus and a second position corresponding to a maximum pressure drop position, wherein the first position provides a minimum flow path flow rate, wherein the second position provides a maximum flow path flow rate, and wherein the actuating step is comprised of actuating the flow control valve mechanism to the second position; and (c) circulating the fluid through the flow path and the pressure drop device.

38. The method as claimed in claim 37 wherein providing the apparatus in the borehole is comprised of inserting the apparatus in the borehole as a component of a working string.

39. The method as claimed in claim 38, further comprising the step of actuating the flow control valve mechanism to the first position.

40. The method as claimed in claim 39 wherein the flow control valve mechanism is actuatable between the first position, the second position and an intermediate position corresponding to an intermediate pressure drop position and wherein the intermediate position provides an intermediate flow path flow rate, further comprising the step of actuating the flow control valve mechanism to the intermediate position.

41. The method as claimed in claim 40 wherein the step of actuating the flow control valve mechanism to the first position, the step of actuating the flow control valve mechanism to the second position, and the step of actuating the flow control valve mechanism to the intermediate position is each comprised of applying a longitudinal movement to the flow control valve mechanism.

42. The method as claimed in claim 41 wherein the first position is a first longitudinal position of the flow control valve mechanism, wherein the second position is a second longitudinal position of the flow control valve mechanism, and wherein the intermediate position is an intermediate longitudinal position of the flow control valve mechanism.

43. The method as claimed in claim 38 wherein the step of actuating the flow control valve mechanism to the second position is comprised of applying a rotational movement to the flow control valve mechanism.

44. The method as claimed in claim 43, further comprising the step of actuating the flow control valve mechanism to the first position.

45. The method as claimed in claim 44 wherein the step of actuating the flow control valve mechanism to the first position is comprised of applying a rotational movement to the flow control valve mechanism.

46. The method as claimed in claim 45 wherein the flow control valve mechanism is actuatable between the first position, the second position and an intermediate position corresponding to an intermediate pressure drop position and wherein the intermediate position provides an intermediate flow path flow rate, further comprising the step of actuating the flow control valve mechanism to the intermediate position.

47. The method as claimed in claim 46 wherein the step of actuating the flow control valve mechanism to the intermediate position is comprised of applying a rotational movement to the flow control valve mechanism.

48. The method as claimed in claim 38 wherein the pressure drop device is comprised of an orifice assembly.

49. The method as claimed in claim 48 wherein the orifice assembly defines a tortuous path for the fluid through the flow path.

50. The method as claimed in claim 49 wherein the orifice assembly is comprised of longitudinally alternating inner orifice flanges and outer orifice flanges.

* * * * *